US008175880B2

(12) United States Patent
Matsuhara et al.

(10) Patent No.: US 8,175,880 B2
(45) Date of Patent: May 8, 2012

(54) IMAGE PROCESSING APPARATUS, IMAGE PROCESSING METHOD AND RECORDING MEDIUM

(75) Inventors: Kenji Matsuhara, Kawanishi (JP); Hiroaki Kubo, Muko (JP); Nobuhiro Mishima, Osaka (JP); Kazuo Inui, Itami (JP)

(73) Assignee: Konica Minolta Business Technologies, Inc., Chiyoda-Ku, Tokyo (JP)

( * ) Notice: Subject to any disclaimer, the term of this patent is extended or adjusted under 35 U.S.C. 154(b) by 664 days.

(21) Appl. No.: 12/372,921

(22) Filed: Feb. 18, 2009

(65) Prior Publication Data

US 2009/0216536 A1 Aug. 27, 2009

(30) Foreign Application Priority Data

Feb. 22, 2008 (JP) ..... 2008-042225

(51) Int. Cl.
*G10L 13/08* (2006.01)

(52) U.S. Cl. ..... 704/260

(58) Field of Classification Search ..... 704/260, 704/258, 251–255, 257, 1–10, 231, 235, 704/270; 235/454; 348/207.2
See application file for complete search history.

(56) References Cited

U.S. PATENT DOCUMENTS 6,876,382 B1 * 4/2005 Sakamoto ..... 348/207.2
7,193,688 B2 3/2007 Takamine et al.
7,318,033 B2 1/2008 Okutani et al.
7,325,735 B2 * 2/2008 Kurzweil et al. ..... 235/454
2001/0051874 A1 12/2001 Tsuji
2007/0213986 A1 * 9/2007 Bodin et al. ..... 704/260

FOREIGN PATENT DOCUMENTS

JP 2000-57327 A 2/2000
JP 2001-075581 3/2001
JP 2001-333378 11/2001
JP 2002-125198 4/2002
JP 2003-110841 A 4/2003
JP 2003-244360 8/2003
JP 2004-070523 A 3/2004

OTHER PUBLICATIONS

Notification of Reasons for Refusal issued in the corresponding Japanese Patent Application No. 2008-042225 dated Feb. 23, 2010, and an English Translation thereof.

* cited by examiner

*Primary Examiner* — Huyen X. Vo

(74) *Attorney, Agent, or Firm* — Buchanan Ingersoll & Rooney PC

(57) ABSTRACT

An image processing apparatus comprises an image data input portion that inputs image data and a text data input portion that inputs text data. The text data inputted by the text data input portion is converted into voice data by a voice data converter, and this obtained voice data and the image data inputted by the image data input portion are connected to each other by a connector, and then a file including the voice data and the image data connected to each other is created.

24 Claims, 22 Drawing Sheets

IMAGE PROCESSING APPARATUS, IMAGE PROCESSING METHOD AND RECORDING MEDIUM

This application claims priority under 35 U.S.C. §119 to Japanese Patent Application No. 2008-042225 filed on Feb. 22, 2008, the entire disclosure of which is incorporated herein by reference in its entirety.

BACKGROUND OF THE INVENTION

1. Field of the Invention

The present invention relates to an image processing apparatus such as an image forming apparatus, and an image processing method.

2. Description of the Related Art

The following description sets forth the inventor's knowledge of related art and problems therein and should not be construed as an admission of knowledge in the prior art.

As generally practiced, paper sheets having presentation materials printed on their front sides and explanatory text data printed on their back sides are handed out, meanwhile a presenter displays presentation materials on a display apparatus such as a projector and orally gives explanation about the materials, which are conventional styles employed when a presentation is made.

However, it is such annoying for reviewers of handed-out paper sheets having presentation materials and explanatory text data printed thereon, to be required to read the explanatory text data, turn the pages and carry the sheets with them, which is a unresolved problem.

Meanwhile, it is such a burden for a presenter to display presentation materials and orally give explanation about the materials, which is also an unresolved problem.

There is an apparatus suggested by Japanese Unexamined Laid-open Patent Publication No. 2004-070523, which executes a character recognition process about inputted texts; converts obtained text data into voice data; and outputs the voice data.

Furthermore, there is a system suggested by Japanese Unexamined Laid-open Patent Publication No. 2000-057327, which records information of images into a predetermined memory area; embeds in a part of the memory area, related information to explain the images as an electronic watermark; and outputs the related information by voice when the images are displayed.

Furthermore, there is an art disclosed by the Japanese Unexamined Laid-open Patent Publication No. 2003-110841, which extracts voice information embedded in images.

However, with the art described in Japanese Unexamined Laid-open Patent Publication No. 2003-110841, inputted texts are just outputted by voice, and it is not applicable to the use of displaying images and giving brief explanation about the images. Generally, it is required for a presentation document that shown images enhance the visual appeal of a presentation and explanation given by voice contributes to an easier understanding about the presentation. In this regard, according to the art described in the Patent Document 1, inputted texts are equivalent to words outputted by voice, and thus, regardless of whether inputted texts are displayed or not displayed, those are just simply outputted by voice, which cannot satisfy the advantages mentioned above.

Furthermore, with the arts described in Japanese Unexamined Laid-open Patent Publications No. 2000-057327 and 2003-110841, it is troublesome to embed related information as an electronic watermark or embed voice information in images, which is an unresolved problem.

The description herein of advantages and disadvantages of various features, embodiments, methods, and apparatus disclosed in other publications is in no way intended to limit the present invention. Indeed, certain features of the invention may be capable of overcoming certain disadvantages, while still retaining some or all of the features, embodiments, methods, and apparatus disclosed therein.

SUMMARY OF THE INVENTION

The preferred embodiments of the present invention have been developed in view of the above-mentioned and/or other problems in the related art. The Preferred embodiments of the present invention can significantly improve upon existing methods and/or apparatuses.

It is an objective of the present invention to provide an image processing apparatus that is capable of displaying images and giving explanation about the images by voice.

It is another objective of the present invention to provide an image processing method that is capable of displaying images and giving explanation about the images by voice.

It is yet another objective of the present invention to provide a computer readable recording medium having an image processing program stored therein to make a computer execute processing by the image processing method.

According to a first aspect of the present invention, an image processing apparatus comprises:

- an image data input portion that inputs image data;
- a text data input portion that inputs text data;
- a voice data converter that converts into voice data, the text data inputted by the text data input portion;
- a connector that connects to each other, the voice data obtained by the voice data converter and the image data inputted by the image data input portion; and
- a file creator that creates a file including the image data and the voice data connected to each other by the connector.

According to a second aspect of the present invention, an image processing apparatus comprises:

- a reader that reads out image data by scanning a document having one or more than one sheets;
- a voice data converter that converts into voice data, text data extracted from the image data read out from the document having one or more than one sheets, by the reader;
- a connector that connects to each other, the voice data obtained by the voice data converter and the image data read out by the reader; and
- an output portion that outputs to a display apparatus, the image data connected to the voice data, to a display apparatus, and outputs the voice data to a speech output apparatus.

According to a third aspect of the present invention, an image processing method comprises:

- inputting image data;
- inputting text data;
- converting the inputted text data into voice data;
- connecting the obtained voice data and the inputted image data to each other; and
- creating a file including the image data and the voice data connected to each other.

According to a fourth aspect of the present invention, an image processing method comprises:

- reading out image data by scanning a document having one or more than one sheets;

converting into voice data, text data extracted from the image data read out from the document having one or more than one sheets;

connecting the obtained voice data and the readout image data to each other; and outputting the image data connected to the voice data, to a display apparatus, and outputting the voice data to a speech output apparatus.

The above and/or other aspects, features and/or advantages of various embodiments will be further appreciated in view of the following description in conjunction with the accompanying figures. Various embodiments can include and/or exclude different aspects, features and/or advantages where applicable. In addition, various embodiments can combine one or more aspect or feature of other embodiments where applicable. The descriptions of aspects, features and/or advantages of particular embodiments should not be construed as limiting other embodiments or the claims.

BRIEF DESCRIPTION OF THE DRAWINGS

The preferred embodiments of the present invention are shown by way of example, and not limitation, in the accompanying figures, in which:

FIG. 2 is employed;

DETAILED DESCRIPTION OF THE PREFERRED EMBODIMENTS

In the following paragraphs, some preferred embodiments of the invention will be described by way of example and not limitation. It should be understood based on this disclosure that various other modifications can be made by those in the art based on these illustrated embodiments.

Figure 1:
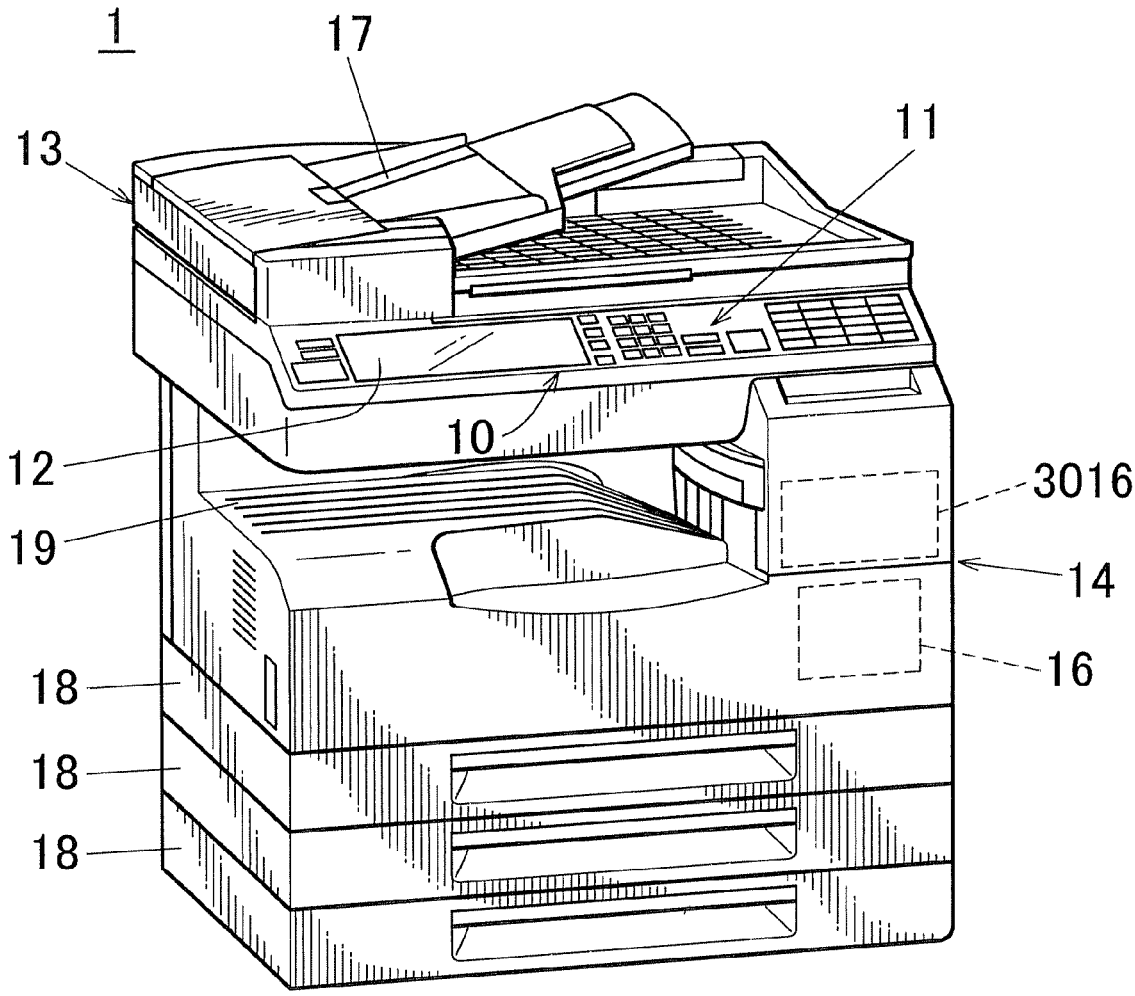
FIG. 1 is a perspective view showing an exterior of an image forming apparatus as a processing apparatus according to one embodiment of the present invention.

FIG. 1 is a perspective view showing an exterior of an image forming apparatus as an image processing apparatus according to one embodiment of the present invention.

An image forming apparatus 1 is a MFP (Multi Function Peripheral) that is a multifunctional digital machine, and has the copy function, the print function, the facsimile function, the scan function, the communication function to communicate with external apparatuses and etc. connected to a network, and other functions.

The image forming apparatus 1 comprises an operation panel 10. This operation panel 10 comprises an operation portion 11 having a plurality of keys and a display 12 having liquid crystal or etc. that displays instruction menus for users, information about obtained images, and etc.

The image forming apparatus 1 further comprises a scanner 13 obtaining image data by photoelectrically reading a document and a printer 14 printing images on recording sheets based on the image data.

And the image forming apparatus 1 has an automatic document feeder 17 conveying a document to the scanner 13, loaded on the top thereof; a sheet feeder 18 feeding recording sheets to the printer 14, loaded in the lower part thereof; and a tray 19 receiving discharged recording sheets carrying images thereon printed by the printer 14, loaded in the central part thereof. In addition, the image forming apparatus 1 has a communicator 16 exchanging image files and etc. with external apparatuses via a network and a memory 3016 storing in itself image files and etc., embedded therein.

The image forming apparatus 1 further comprises a network interface to be described later, and the communicator 16 is connected to a network by the network interface in order to exchange various data with external apparatuses.

The scanner 13 obtains image data by photoelectrically reading out image information such as photos, texts and pictures from a document. The obtained image data (density data) is converted into digital data and various image processes are performed about the digital data, by an image processor not shown in Figures. After that, the processed data is transmitted to the printer 14 or stored in the memory 3016 for later use.

The printer 14 prints images on recording sheets based on image data obtained by the scanner 13 and image data stored in the memory 3016.

The communicator 16 exchanges facsimile data via a public phone line and also exchanges via networks such as Internet, LAN and etc., data with external apparatuses connected to the networks by using e-mails and etc.

By using the communicator 16, the MFP 1 functions as a facsimile apparatus performing ordinary facsimile communication and as an e-mail sending/receiving terminal. And thus, the MFP 1 is allowed to send and receive various image data as e-mail attachments. A network communication performed by the image forming apparatus 1 may be wired or wireless, whichever is available. In Figures, a wired communication system is employed for example.

Hereinafter, an electrical configuration of the image forming apparatus 1 will be explained with reference to the block diagrams shown in FIG. 2.

Figure 2:
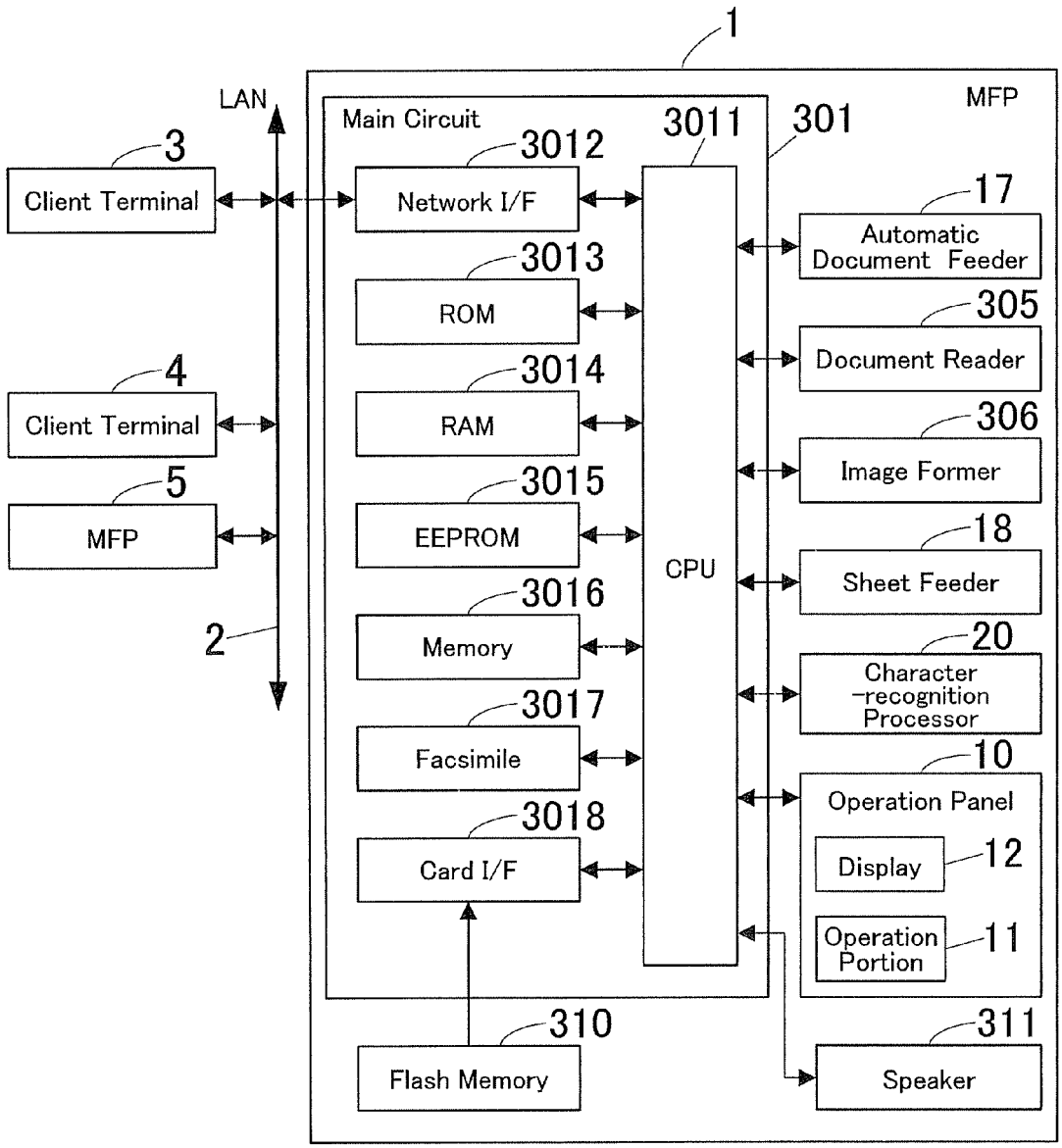
FIG. 2 is a block diagram showing an electrical configuration of the image forming apparatus.

As shown in FIG. 2, the image forming apparatus 1 comprises a main circuit 301, a character-recognition processor 20, a speaker 311 and etc. as well as the above-mentioned automatic document feeder 17, a document reader 305 that is the above-mentioned scanner 13, an image former 306 that is the above-mentioned printer 14, the sheet feeder 18 and the operation panel 10.

The main circuit 301 comprises a CPU 3011, a network interface (network I/F) 3012, a ROM 3013, a RAM 3014, an EEPROM (Electrically Erasable Programmable Read Only Memory) 3015, the above-mentioned memory 3016, a facsimile portion 3017 and a card interface (card I/F) 3018.

The CPU 3011 integrally controls the entire image forming apparatus 1, for example controls a print operation, a copy operation, a scan operation, a facsimile sending/receiving operation, an e-mail sending/receiving operation and other operations thereof, by executing a program stored in the ROM 3013 or etc. Additionally, in this embodiment, it controls the following operations for example: inputted text data is converted into voice data, and the obtained voice data and appropriate image data for the text data are connected to each other, and a file including the image data and the voice data (hereinafter, it will be also referred to as "voice-attached file") is created. And according to need, an area judgment process is performed about the image data and thus a text part (also referred to as "character part") is extracted therefrom and a character-recognition process (OCR process) is performed about the text part and thus text data is extracted therefrom. Furthermore, inputted image data is outputted to a display apparatus such as a projector and the voice data is outputted to the speaker 311. Detailed explanation thereof will be explained later.

The network interface 3012 serves as a sender/receiver to exchange data with client terminals 3, 4 and 6 that are personal computers and etc. and other external apparatuses such as a MFP 5, via a network 2 such as a LAN (Local Area Network).

The ROM 3013 stores in itself a program executed by the CPU 3011 and other data, and the RAM 3014 serves as an operating area for the CPU 3011 to execute the program.

The EEPROM 3015 is a rewritable memory storing in itself various data. In this embodiment, it stores in itself user names, e-mail addresses, cell-phone terminals' names, cell-phone terminals' phone numbers, login IDs and etc. of clients (users).

The memory 3016 is a nonvolatile memory such as a hard disk (HDD), and stores in itself, for example, a voice-attached file including voice data and image data connected to each other as described above, ordinary image data read out from a document by the document reader 305, ordinary image data received externally, and other data.

The facsimile portion 3017 performs a facsimile communication with external facsimile apparatuses.

The card interface 3018 is an interface exchanging data with a flash memory 310 or etc., for example.

The character-recognition processor 20 extracts text data from a text part of image data read out from a document, by a character-recognition process. This extracted text data is converted into voice data by the CPU 3011.

The speaker 311 serves as a speech output apparatus. The speaker 311 may be provided separately from the image forming apparatus 1 and wiredly or wirelessly connected to the image forming apparatus 1.

Figure 3:
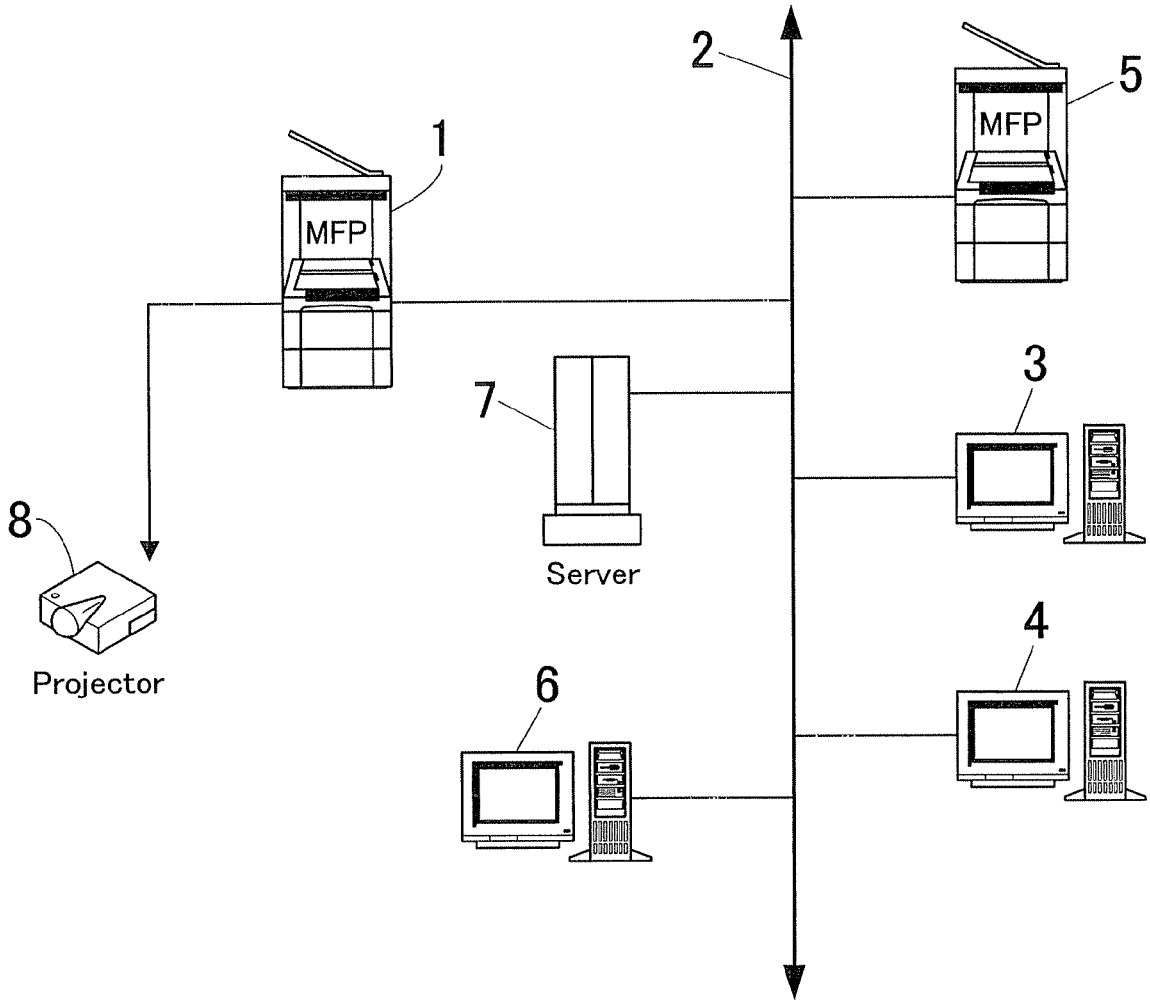
FIG. 3 is a view showing a configuration of an image and speech output system in which the image forming apparatus shown in FIG. 1

FIG. 3 is a view showing a configuration of an image and speech output system in which the image forming apparatus 1 shown in FIG. 1 and FIG. 2 is employed. In this image and speech output system, the image forming apparatus 1 is connected via the network 2, to the client terminals 3, 4 and 6, the image forming apparatus 5 other than the image forming apparatus 1, and a server 7. Furthermore, a projector 8 that is a display apparatus is connected to the image forming apparatus 1. And thus, if image data is outputted to the projector 8 from the image forming apparatus 1, images are projected by the projector 8, on a screen or etc. not shown in Figures.

The display apparatus is not limited to the projector 8. And the display apparatus may be integrally provided to the image forming apparatus 1.

Figure 4:
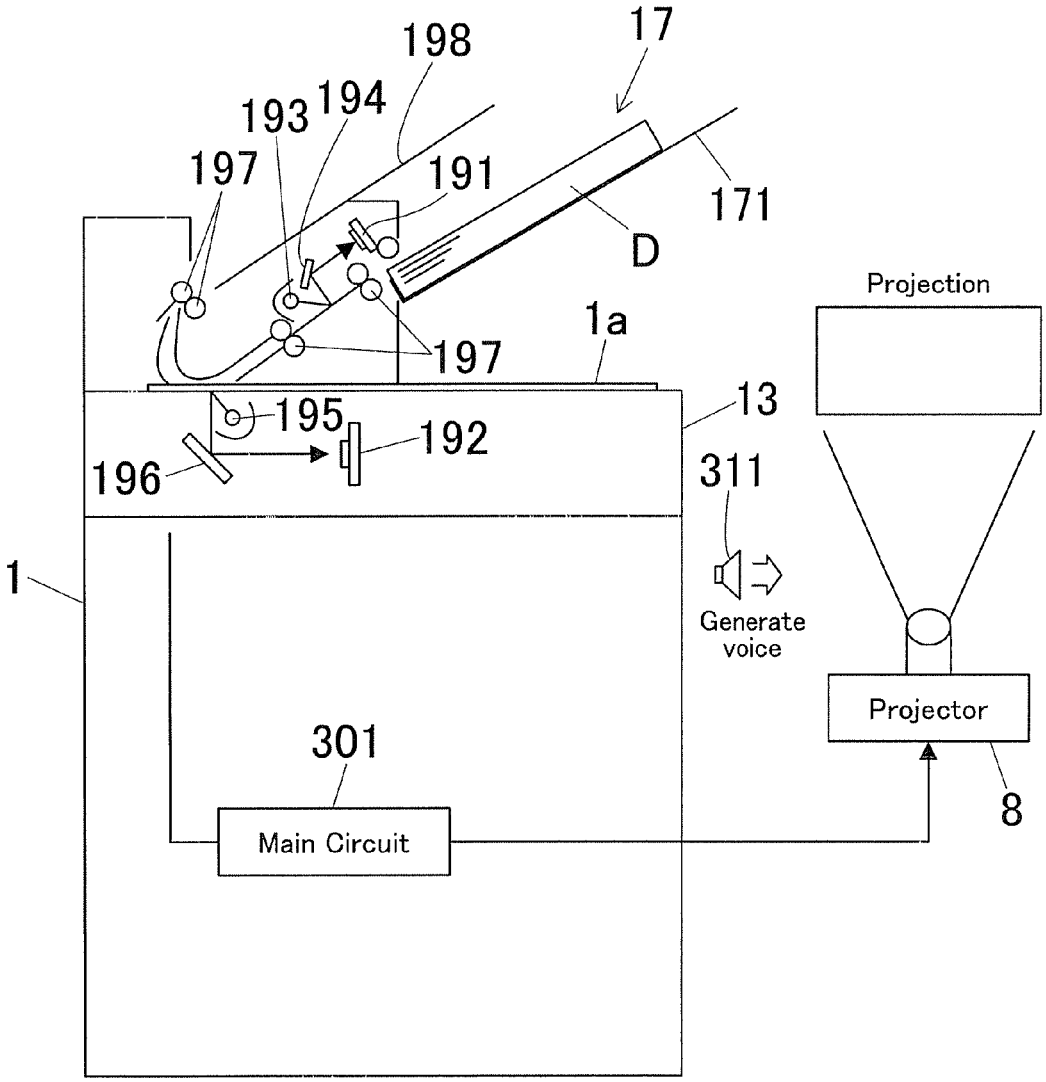
FIG. 4 is a view to explain primary portions of a scanner (a document reader) and an automatic document feeder.

FIG. 4 is a view to explain primary portions of the scanner 13 (the document reader 305) and the automatic document feeder 17.

In this embodiment, the scanner 13 is capable of reading at one time, both front and back sides of a document D during one conveyance of the document D. Concretely, in order to read the document D set on a document tray 171 of the automatic document feeder 17, the document D is conveyed to a platen glass 1*a* of the image forming apparatus 1 in the lower oblique direction, by conveyance rollers 197 that are a plurality of pairs of rollers. After that, it is returned around and guided back in the upper oblique direction, then discharged on a document discharge tray 198.

In the vicinity of the document path from the document tray 171 to the platen glass 1*a*, there provided a light source 193, a reflecting mirror 194 and a first reader including an image pickup portion 191 such as a CCD. One side (an upper side) of the document D conveyed from the document tray 171 is lighted by the light source 193, and the light reflected from the document D is further reflected by the reflecting mirror 194 then received by the image pickup portion 191.

Under the platen glass 1*a*, where the document D conveyed from the document tray 171 goes by, there provided a light source 195, a reflecting mirror 196 and a second reader 192 including an image pickup portion such as a CCD. The other side (a lower side) of the document D conveyed from the document tray 171 is lighted by the light source 195 via the platen glass 1*a*, and the light reflected from the document D1 is further reflected by the reflecting mirror 196 then received by the image pickup portion 192.

Subsequently, image data pieces read out from both the front and back sides by the image pickup portions 191 and 192 are processed by the main circuit 301 and etc., and the projector 8 and the speaker 311 perform operations based on the processing result under the control, accordingly.

Meanwhile, in order to read only one side of the document D, only the light source 195, the reflecting mirror 196 and the second reader including the image pickup portion 192 perform operations.

Meanwhile, another example not shown in Figures is also applicable, in which one side of the document D is read by only one reader, and the document D is reversed, then the other side thereof is read by the same one reader. Thus, both sides of the document D can be read one by one, sequentially.

Figure 5:
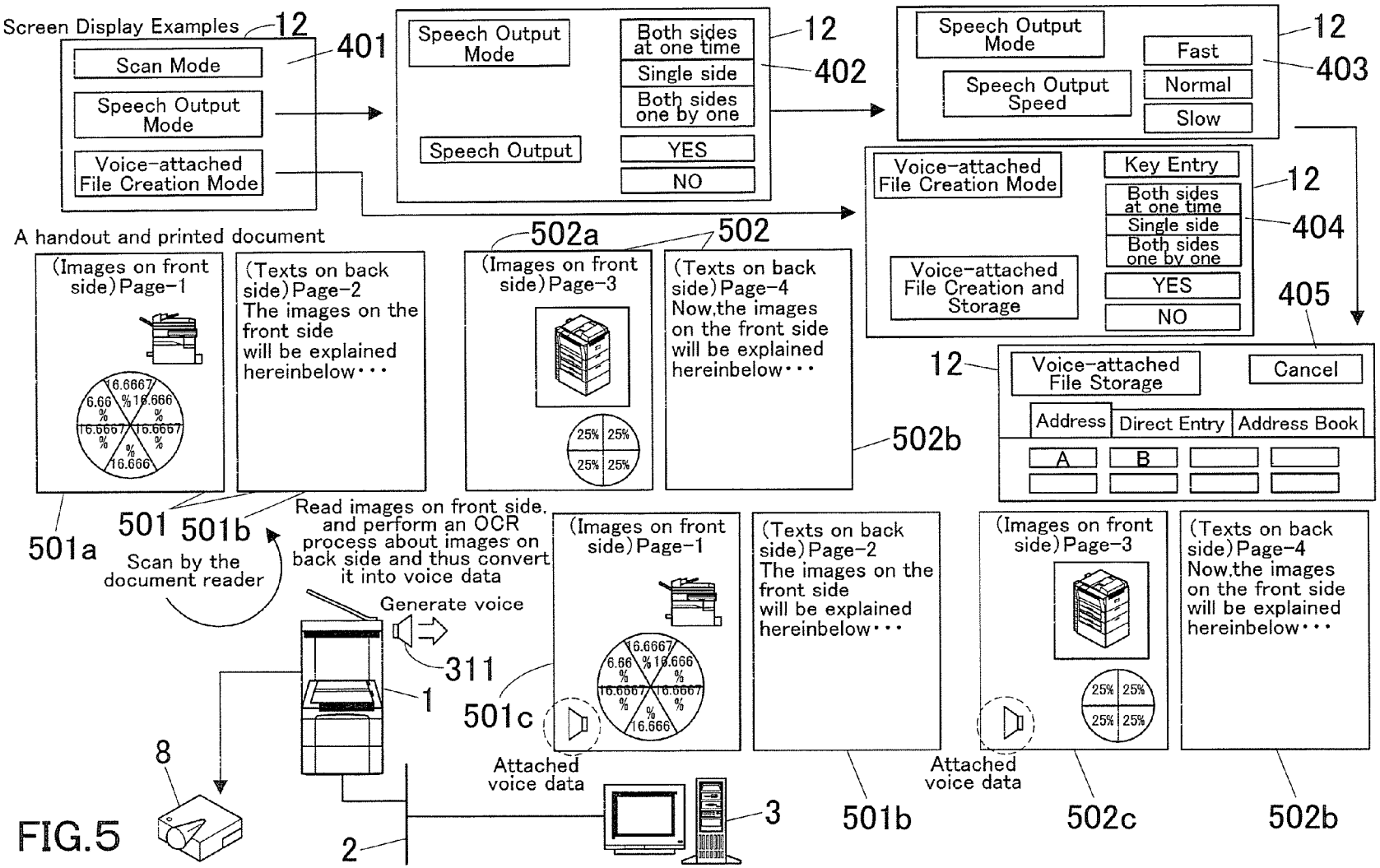
FIG. 5 is a view to explain an example of a procedure executed in the image forming apparatus that is employed in the image and speech output system shown in *Fig.* 3.

FIG. 5 is a view to explain an example of a procedure executed in the image forming apparatus 1 that is employed in the image and speech output system shown in FIG. 3.

In this example, one or more than one sheets (a document) having images printed on the front side(s) and texts printed on the back side(s), should be prepared. Concretely, for example in this embodiment, images are printed on a front side 501*a* (Page 1) of a first sheet 501, texts (including appended comments and annotations) to explain the images of Page 1 are printed on a back side 501*b* (Page 2) thereof, images are printed on a front side 502*a* (Page 3) of a second sheet 502, texts to explain the images of Page 3 are printed on a back side 502*b* (Page 4) thereof.

A mode selection screen 401 is displayed on the display 12 of the operation panel 10, and in this screen, a "scan mode" button, a "speech output mode" button and a "voice-attached file creation mode" button are displayed.

The "scan mode" is a mode to read a document by the document reader 305, which is performed independently from an operation performed about voice data.

The "speech output mode" is a mode to repeat the following operation as many times as the number of sheets: projecting by the projector 8 images on a sheet read by the document reader 305; converting into voice data texts about the images; and outputting speech by the speaker 311. The "voice-attached file creation mode" is a mode to convert into voice data, texts on a sheet read by the document reader 305 and create a file (voice-attached file) including the obtained voice data and image data read out from the document, which are connected to each other.

If the "speech output mode" button is pressed in the mode selection screen 401, the screen is switched to a speech output mode setting screen 402. In this speech output mode setting screen 402, a "both sides at one time" button, a "single side" button, a "both sides one by one" button, and a "YES" button and a "NO" button allowing users to answer if they are really going to output speech, are displayed.

The "both sides at one time" button will be pressed if images are printed on a front side of a document and texts are printed on a back side thereof, separately. The "single side" button will be pressed if images and texts are printed together on one side of a document. The "both sides one by one" button will be pressed if images and texts are printed together on each side of a document, in order to read both sides thereof one by one, sequentially.

In the example shown in FIG. 5, the "both sides at one time" button is pressed since images are printed on a front side of a document and texts are printed on a back side thereof, separately.

Subsequently, if the "NO" button is pressed, the screen is switched back to the screen 401 that is the previous screen. If the "YES" button is pressed, the screen is switched to a speech output speed setting screen 403. In this example, three selection buttons of different speed levels "fast" "normal" and "slow" are displayed. If any of the buttons is pressed and thereby a speech output speed (voice output speed) is determined, a sheet feed speed of the automatic document feeder 17 is calculated based on the determined speech output speed. And thus, a sheet is conveyed to a reading position of the document reader 305 at the calculated speed, then images on a front side of the sheet and texts on a back side thereof are read at one time.

A character-recognition process (OCR process) is performed by the character-recognition processor 20 about the texts on the back side and thus those are converted into text data. And then, it is further converted into voice data.

The image data read out from the front side is outputted to the projector 8 then projected on a screen or etc. by the projector 8. Meanwhile, the voice data is outputted to the speaker 311 then speech is outputted accordingly. And thus, explanation about the images displayed on a screen or etc. is automatically given by voice.

In this embodiment, the timing of completion of speech is calculated. Concretely, the timing of start of projecting a following image is adjusted to the timing of completion of speech, so that a second sheet could be conveyed to a reading position by the automatic document feeder 17 at an appropriate timing. And as in the case of the first sheet, image data read out from a front side of the second sheet is projected by the projector 8, and voice data connected thereto is outputted to the speaker 311 then speech is outputted accordingly.

If output of speech about all the sheets is completed, a voice-attached file destination setting screen 405 is displayed on the display 12 of the operation panel 10. Via this screen 405, a destination to store created voice-attached files can be specified.

If a destination to store voice-attached files is determined, the image data pieces read out from the front sides of the respective sheets are converted into PDF (Portable Document Format) files, for example. And the voice data pieces connected thereto, originating from the back sides of the respective sheets, are attached to the PDF files to make into voice-attached files 501*c* and 502*c*, then those are stored into the determined destination, together with the image data pieces read out from the back sides 501*b* and 502*b*. Meanwhile, if a "cancel" button is pressed in the voice-attached file destination setting screen 405, the operation to store the voice-attached files is canceled, and the procedure is immediately terminated.

On the other hand, if the "voice-attached file creation mode" button is pressed in the mode selection screen 401, the screen displayed on the display 12 is switched to a voice-attached file creation mode setting screen 404. In this screen 404, a "key entry" button, the "both sides at one time" button, the "single side" button and the "both sides one by one" button, as well as the "YES" button and the "NO" button allowing users to answer if they are really going to store voice-attached files, are displayed.

The "key entry" button will be pressed if voice data is inputted via the operation panel 10.

The "both sides at one time" button will be pressed if images are printed on a front side of a document and texts are printed on a back side thereof, separately. The "single side" button will be pressed if images and texts are printed together on one side of a document. The "both sides one by one" button will be pressed if images and texts are printed together on each side of a document, in order to read both sides thereof one by one, sequentially.

In the example shown in FIG. 5, the "both sides at one time" is pressed since images are printed on a front side of a document and texts are printed on a back side thereof, separately.

Subsequently, if the "NO" button is pressed, the screen is switched back to the mode selection screen 401. If the "YES" button is pressed, a sheet set on the automatic document feeder 17 is conveyed to a reading position of the document reader 305, then images on a front side of the sheet and texts on a back side thereof are read at one time.

A character-recognition process is performed about the texts on the back side and thus those are converted into text data. And then, it is further converted into voice data. Meanwhile, image data read out from the front side is converted into a PDF file, then the voice data connected thereto is attached to the PDF file to make into a voice-attached file 501*c*.

If the document has a plurality of sheets, the operation described above is repeatedly performed about the respective sheets.

If creation of voice-attached files about all the sheets is completed, the voice-attached file destination setting screen 405 is displayed on the display 12 of the operation panel 10. And if a destination to store the created voice-attached files is determined, the voice-attached files are stored into the determined destination.

As described above in this embodiment, a character-recognition process is performed about text data read out by the document reader 305, and then it is converted into voice data. This obtained voice data and image data read out by the document reader 305 are connected to each other to make into a voice-attached file. Then, if users simply perform an operation to instruct the document reader 305 to read a document having texts to be outputted by voice and images to be displayed, printed thereon, voice-attached files are automatically created. And by using this file, images can be displayed and explanation about the images can be given by voice.

If the document has a plurality of pages, image data read out from one page is outputted to a projector, output of speech about the page is started, and this operation is repeatedly performed about the respective pages. In this way, images on the respective pages can be displayed one by one, sequentially, and speech about the images can be outputted smoothly, which could achieve a preferred image forming apparatus for the use of displaying presentation materials and giving explanation about the materials by voice, for example.

Figure 6:
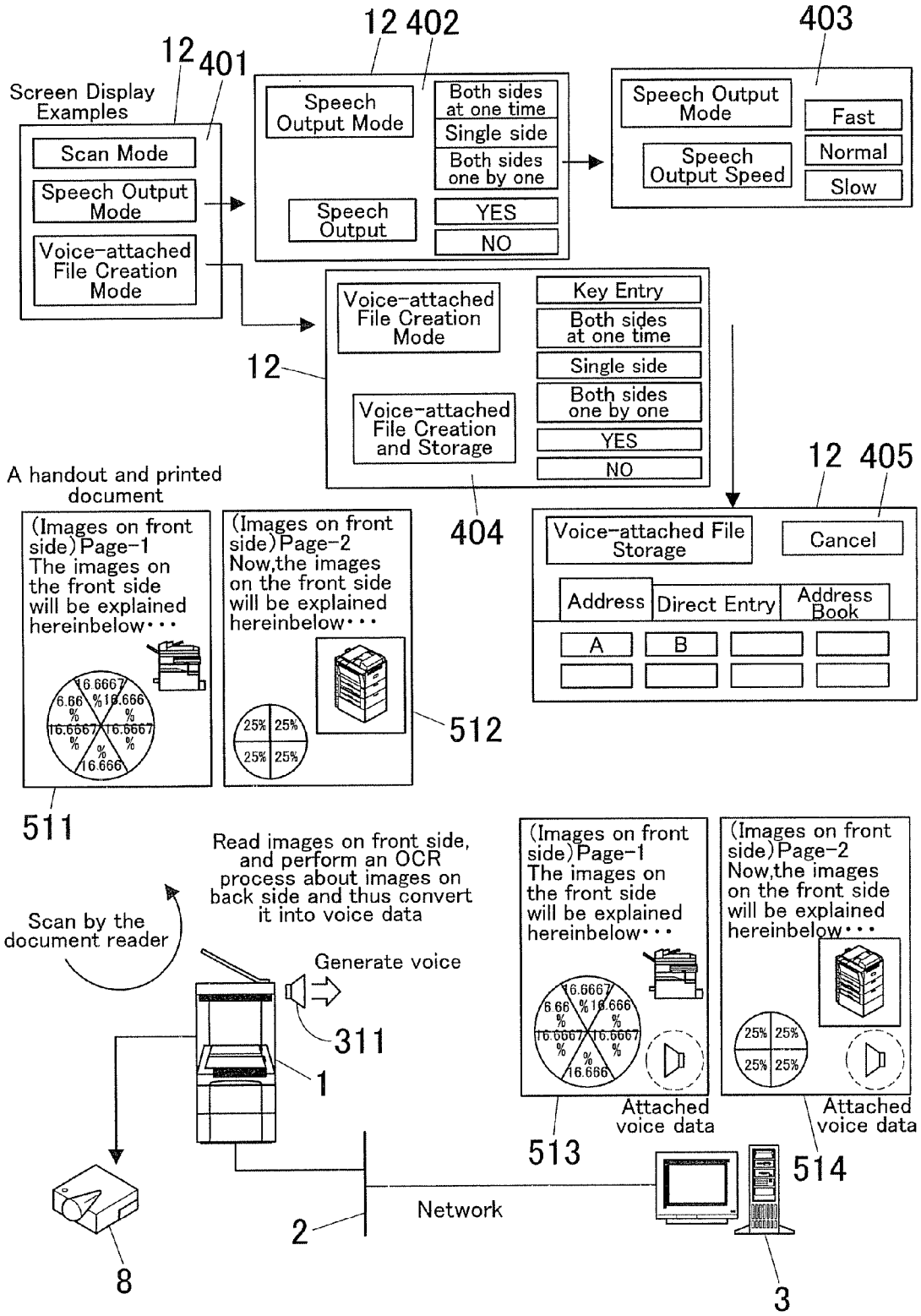
FIG. 6 is a view to explain another procedure executed in the image forming apparatus.

FIG. 6 is a view to explain another procedure executed in the image forming apparatus 1.

This is an example in which images and texts are read by the document reader 305 and the texts are converted into voice data, if the images and the texts are printed together on one side of a document.

As shown in FIG. 6, since the screens 401, 402, 403, 404 and 405 displayed on the display 12 of the operation portion 10 are exactly the same as those shown in FIG. 5, explanation thereof is omitted.

In this example, the "single side" button is pressed in the speech output mode setting screen 402.

Subsequently, any of the speech output speed selection buttons is pressed in the speech output speed setting screen 403 and thereby a speech output speed is determined. And a first sheet 511 is conveyed to a reading position of the document reader 305 by the automatic document feeder 17 at the determined speech output speed, then images and texts on one side of the sheet are read at one time.

An area judgment process is performed about image data read out from the first sheet 511 and thus a text portion is extracted therefrom. And a character-recognition process is performed by the character-recognition processor 20 about the extracted text portion and thus it is converted into text data. After that, the text data is further converted into voice data.

The image data read out from the first sheet 511 is outputted to the projector 8 then projected on a screen or etc. by the projector 8. Meanwhile, the voice data is outputted to the speaker 311 then speech is outputted accordingly. And thus, explanation about the images displayed on a screen or etc. is automatically given by voice.

Subsequently, a second sheet 512 is conveyed to a reading position by the automatic document feeder 17 at an appropriate timing calculated based on the timing of completion of speech. And as in the case of the first sheet 511, image data read out from the second sheet 512 is projected by the projector 8, meanwhile voice data connected thereto is outputted to the speaker 311 then speech is outputted accordingly.

If output of speech about the images on all the sheets is completed, the voice-attached file destination setting screen 405 is displayed on the display 12 of the operation panel 10. If a destination to store voice-attached files is determined, the image data pieces read out from the respective sheets, including image and text portions together, are converted into PDF files, for example. After that, the voice data pieces connected thereto are attached to the PDF files to make into voice-attached files 513 and 514, then the voice-attached files are stored into the determined destination.

And thus, the voice-attached files 513 and 514 stored therein have the voice data attached to the image data. By using these voice-attached files, images can be displayed and speech about the images can be outputted, in an easier manner without the need of converting text data into voice data.

Meanwhile, if an instruction to cancel the operation to store the voice-attached files is issued, the procedure is terminated immediately.

As described above in this embodiment, even if images and texts are printed together on one side of a document, the texts are converted into voice data and the voice data is attached to image data, and thereby a voice-attached file can be created.

Figure 7:
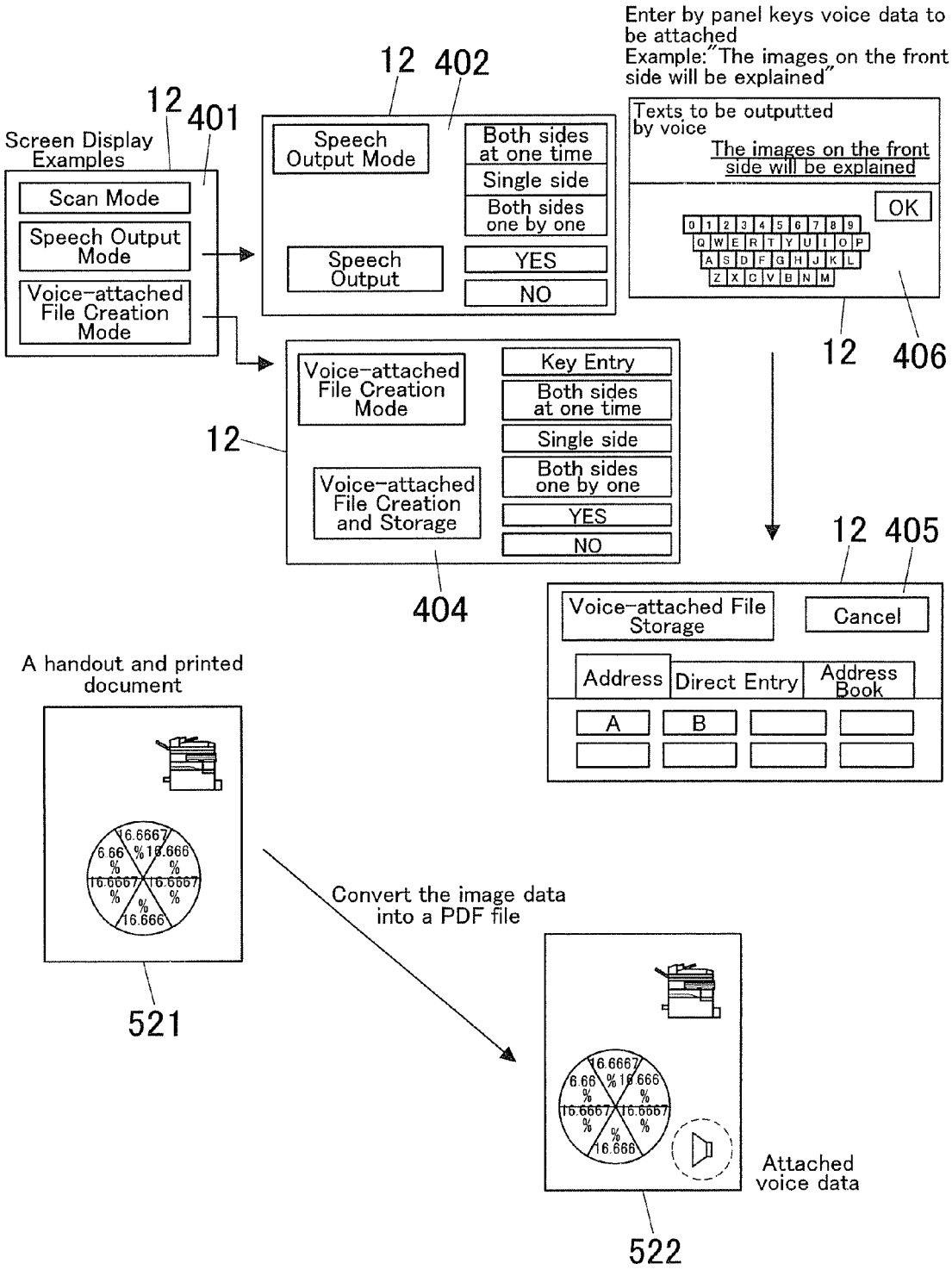
FIG. 7 is a view to explain yet another procedure executed in the image forming apparatus.

FIG. 7 is a view to explain yet another procedure executed in the image forming apparatus 1.

In this example, voice data is inputted via the operation panel 10. Since the screens 401, 402, 403, 404 and 405 displayed on the display 12 of the operation portion 10 are exactly the same as those shown in FIG. 5, explanation thereof is omitted.

If the "key entry" button is pressed then the "YES" button is pressed in the voice-attached file creation mode setting screen 404, a sheet 521 of a document set on the automatic document feeder 17 is conveyed to a reading position of the document reader 305, then the sheet 521 is read.

Image data read out from the sheet 521 is converted into a PDF file, for example. And a panel key screen 406 is displayed on the display 12 of the operation panel 10.

If a user enters texts to be outputted by voice ("the images on the front side will be explained" in the example shown in FIG. 7) then press the "OK" button, the inputted texts are converted into voice data, and the voice data is attached to the PDF file to make into a voice-attached file 522.

If the document has a plurality of sheets, the operation described above is repeatedly performed about the respective sheets.

If creation of voice-attached files about all the sheets is completed, the voice-attached file destination setting screen 405 is displayed on the display 12 of the operation panel 10. And if a destination to store the created voice-attached files is determined, the voice-attached files are stored into the determined destination.

As described above in this embodiment, texts are inputted by the operation panel 10 then converted into voice data, and thereby a voice-attached file can be created.

Figure 8:
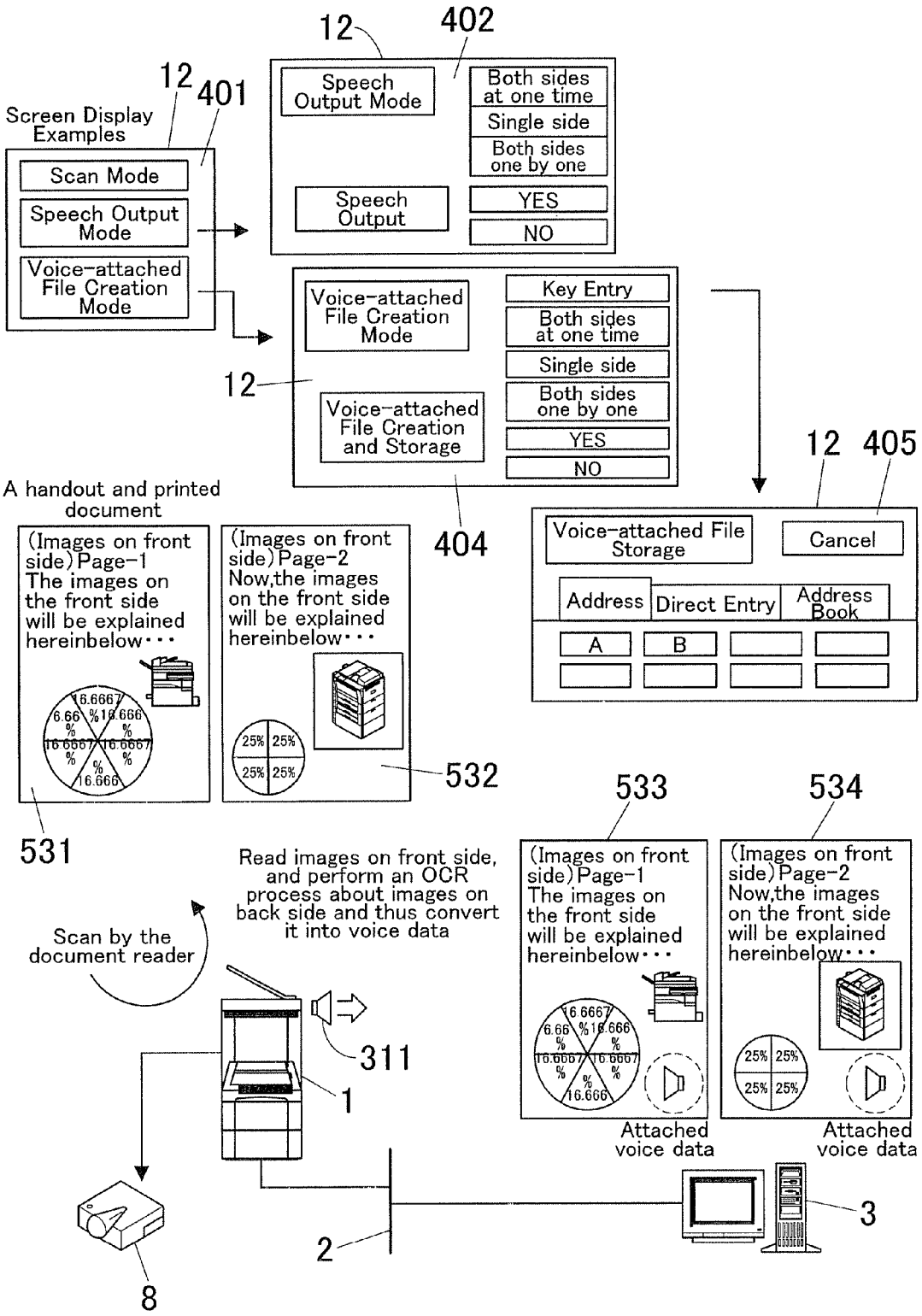
FIG. 8 is a view to explain a procedure executed if a "voice-attached file creation mode" button is pressed in a mode selection screen 401 shown in FIG. 6 and then a "single side" button is pressed in a voice-attached file creation mode setting screen 404.

FIG. 8 is a view to explain a procedure executed if the "voice-attached file creation mode" button is pressed in the mode selection screen 401 then the "single side" button is pressed in the voice-attached file creation mode setting screen 404.

If the "YES" button is pressed in the mode selection screen 401, a sheet 531 of a document set on the automatic document feeder 17 is conveyed to a reading position of the document reader 305, then images and texts on one side of the sheet 531 are read at one time.

An area judgment process is performed about image data read out from the sheet 531 and thus a text portion is extracted therefrom. And a character-recognition process is performed about the extracted text portion by the character-recognition processor 20 and thus it is converted into text data. And then, it is further converted into voice data. Meanwhile, image data read out from the sheet 531 is converted into a PDF file, for example. After that, the voice data is attached to the PDF file to make into a voice-attached file 533.

If the document has a plurality of sheets, the operation described above is repeatedly performed about the respective sheets.

If creation of voice-attached files about all the sheets is completed, the voice-attached file destination setting screen 405 is displayed on the display 12 of the operation panel 10. And if a destination to store the created voice-attached files is determined, the voice-attached files are stored into the determined destination.

Figure 9:
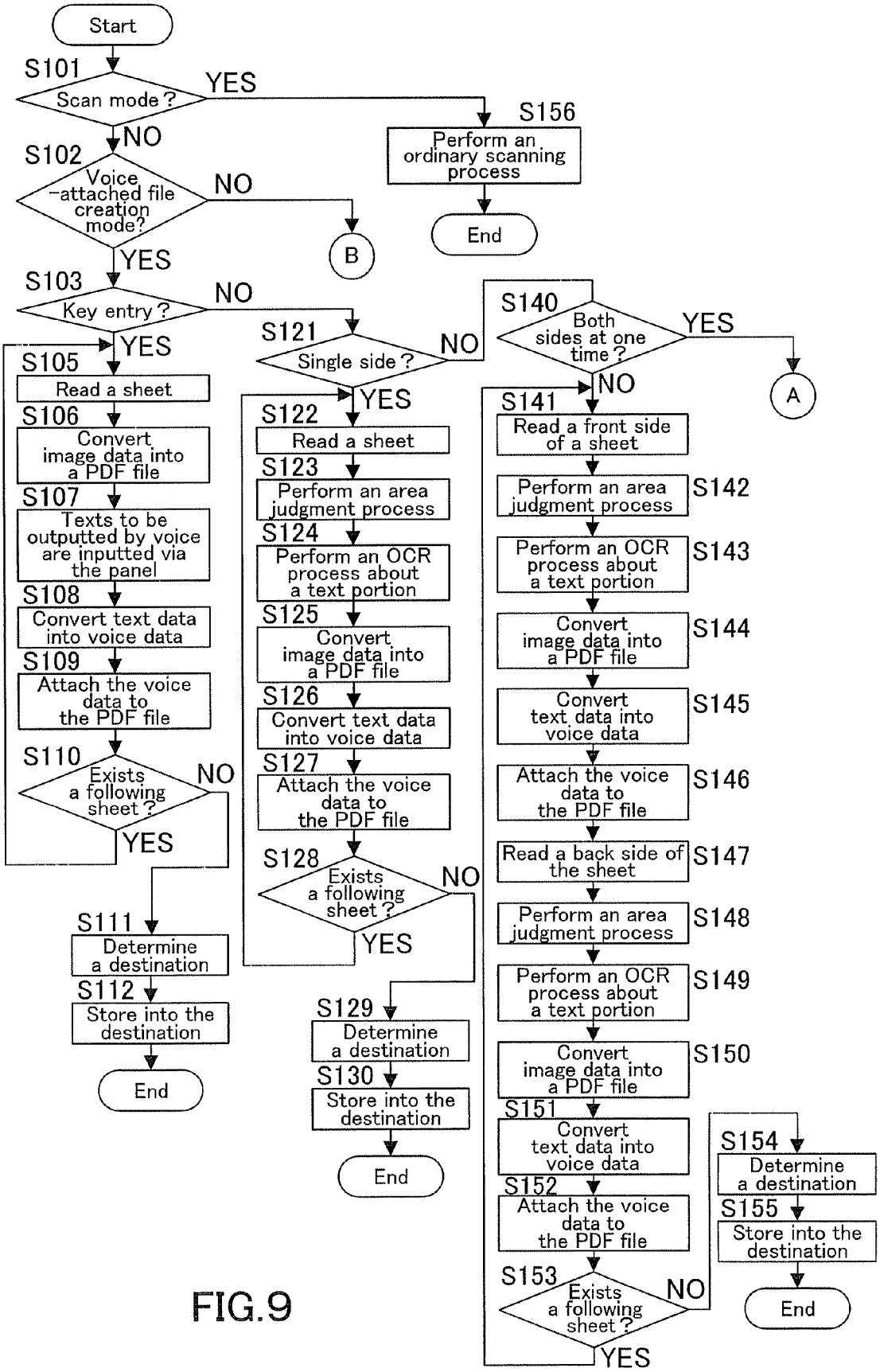
FIG. 9 is a flowchart showing a procedure executed in the image forming apparatus, in which a document is read by the document reader, and a voice-attached file is created and/or speech is outputted.

Hereinafter, the procedures executed in the image forming apparatus 1 will be represented by a flowchart shown in FIG. 9, in which a document is read by the document reader 305 and a voice-attached file is created and/or speech is outputted, as explained with FIG. 5 through FIG. 8.

These procedures are executed by the CPU 3011 of the main circuit 301 according to an operation program recorded in a recording medium such as the ROM 3013.

In Step S101, it is judged whether or not the "scan mode" button is pressed in the mode selection screen 401. If it is pressed (YES in Step S101), an ordinary scanning process is performed in Step S156.

If the "scan mode" button is not pressed (NO in Step S101), then it is judged in Step S102 whether or not the "voice-attached file creation mode" button is pressed. If it is not pressed (NO in Step S102), the routine proceeds to Step S161 of FIG. 11 since it is judged that the "speech output mode" button is pressed. If the "voice-attached file creation mode" button is pressed (YES in Step S102), the routine proceeds to Step S103.

In Step S103, it is judged whether or not the "key entry" button is pressed in the voice-attached file creation mode setting screen 404. If it is pressed (YES in Step S103), the routine proceeds to Step S105 after the "YES" button is pressed in the voice-attached file creation mode setting screen 404, and in Step S105, a sheet of a document is read by the document reader 305 and obtained image data is converted into a PDF file.

Subsequently, if texts to be outputted by voice are inputted via the panel key screen 406 displayed on the display 12 of the operation panel 10, the inputted texts are accepted in Step S107. The inputted texts are converted into voice data in Step S108, and the voice data is attached to the PDF file to make into a voice-attached file in Step S109. And then the routine proceeds to Step S110.

In Step S110, it is judged whether or not the document has a following sheet. If the document has a following sheet (YES in Step S110), the routine goes back to Step S105 and repeats Steps S105 through S110.

If the document does not have any following sheet (NO in Step S110), a destination to store the voice-attached files, which is entered by user via the voice-attached file destination setting screen 405, is determined in Step S111. Then in Step S121, the voice-attached files are stored into the destination.

Meanwhile, if the "key entry" button is not pressed in Step S103 (NO in Step S103), then it is judged in Step S121 whether or not the "single side" button is pressed.

If the "single side" button is pressed (YES in Step S121), the routine proceeds to Step S122 after the "YES" button is pressed in the voice-attached file creation mode setting screen 404. A sheet of the document is read by the document reader 305 in Step S122, and an area judgment process is performed about the obtained image data and thus a text portion is extracted therefrom, in Step S123.

A character-recognition process is performed about the extracted text portion in Step S124, and image data read out therefrom is converted into a PDF file in Step S125.

Text data obtained by the character-recognition process is converted into voice data in Step S126, and the voice data is attached to the PDF file to make into a voice-attached file in Step S127. Then the routine proceeds to Step S128.

In Step S128, it is judged whether or not the document has a following sheet. If the document has a following sheet (YES in Step S128), the routine goes back to Step S122 and repeats Steps S122 and S128.

If the document does not have any following sheet (NO in Step S128), a destination to store the voice-attached files, which is entered by user via the voice-attached file destination setting screen 405, is determined in Step S129. Then in Step S130, the voice-attached files are stored into the destination.

Meanwhile, if the "single side" button is not pressed in Step S121 (NO in Step S121), then it is judged in Step S140 whether or not the "both sides at one time" button is pressed. If the "both sides at one time" button is not pressed (NO in Step S140), the routine proceeds to Step S141 since it is judged that the "both sides one by one" button is pressed.

In Step S141, a front side of a sheet is read by the document reader 305 after the "YES" button is pressed in the voice-attached file creation mode setting screen 404. Then an area judgment process is performed about the obtained image data and thus a text portion is extracted therefrom, in Step S142.

Subsequently, a character-recognition process is performed about the extracted text portion in Step S143, and image data read out from the front side is converted into a PDF file in Step S144.

And text data obtained by the character-recognition process is converted into voice data in Step S145, and the voice data is attached to the PDF file to make into a voice-attached file in Step S146. Then the routine proceeds to Step S147.

A back side of the sheet is read by the document reader 305 in Step S147, and an area judgment process is performed about image data read out from the back side and thus a text portion is extracted therefrom, in Step S148.

A character-recognition process is performed about the extracted text portion in Step S149, and the image data read out from the back side is converted into a PDF file in Step S150.

Text data obtained by the character-recognition process is converted into voice data in Step S151, and the voice data is attached to the PDF file to make into a voice-attached file in Step S152. Then the routine proceeds to Step S153.

In Step S153, it is judged whether or not the document has a following sheet. If the document has a following sheet (YES in Step S153), the routine goes back to Step S141 and repeats Steps S141 through S153.

If the document does not have any following sheet (NO in Step S153), a destination to store the voice-attached files, which is entered by user via the voice-attached file destination setting screen 405, is determined in Step S154. Then in Step S155, the voice-attached files are stored into the destination.

Figure 10:
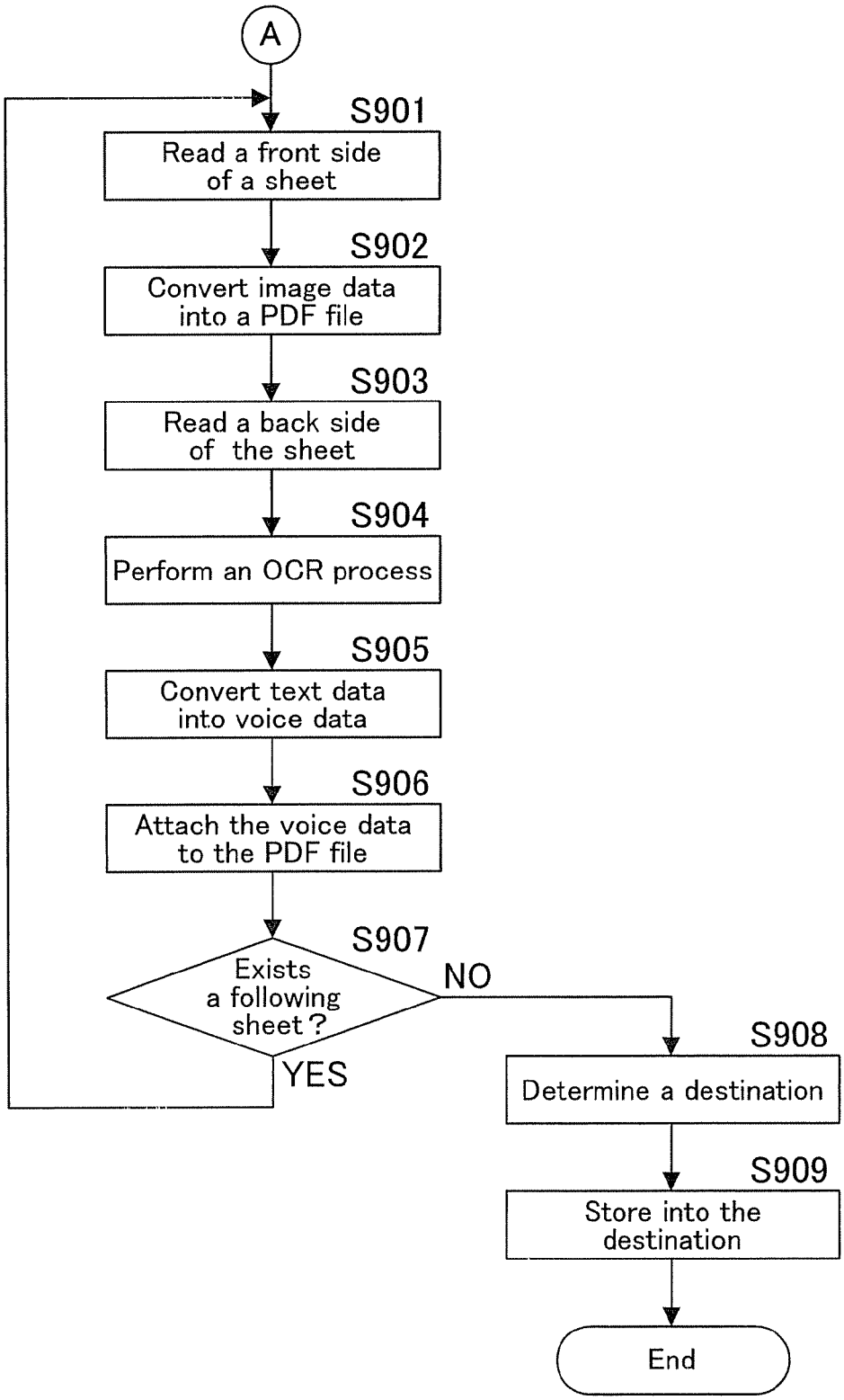
FIG. 10 is a flowchart continued from the flowchart of FIG. 9.

Meanwhile, if the "both sides at one time" button is pressed in Step S140 (YES in Step S140), the routine proceeds to Step S901 of FIG. 10.

In Step S901, a front side of a sheet is read by the document reader 305. And image data read out therefrom is converted into a PDF file in Step S902.

Then in Step S903, a back side of the sheet is read by the document reader 305. And a character-recognition process is performed about image data read out from the back side in Step S904, and text data obtained by the character-recognition process is converted into voice data in Step S905. The voice data is attached to the PDF file originating from the front side to make into a voice-attached file in Step S906, and then the routine proceeds to Step S907.

In Step S907, it is judged whether or not the document has a following sheet. If the document has a following sheet (YES in Step S907), the routine goes back to Step S901 and repeats Steps S901 through S907.

If the document does not have any following sheet (NO in Step S907), a destination to store the voice-attached files, which is entered by user via the voice-attached file destination setting screen 405, is determined in Step S908. Then in Step S909, the voice-attached files are stored into the destination.

Figure 11A:
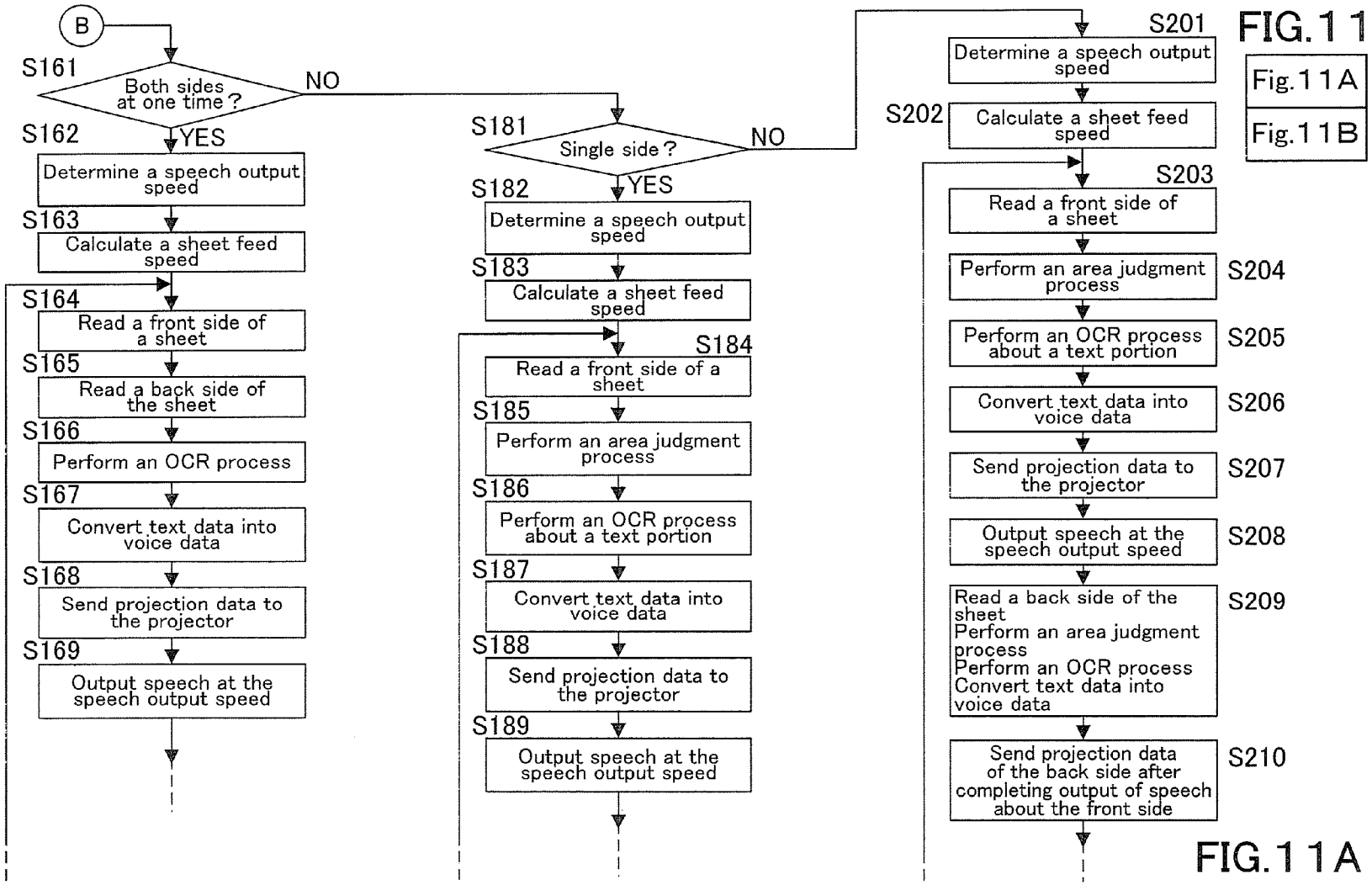
FIG. 11 is a flowchart continued from the flowchart of FIG. 9.
Figure 11B:
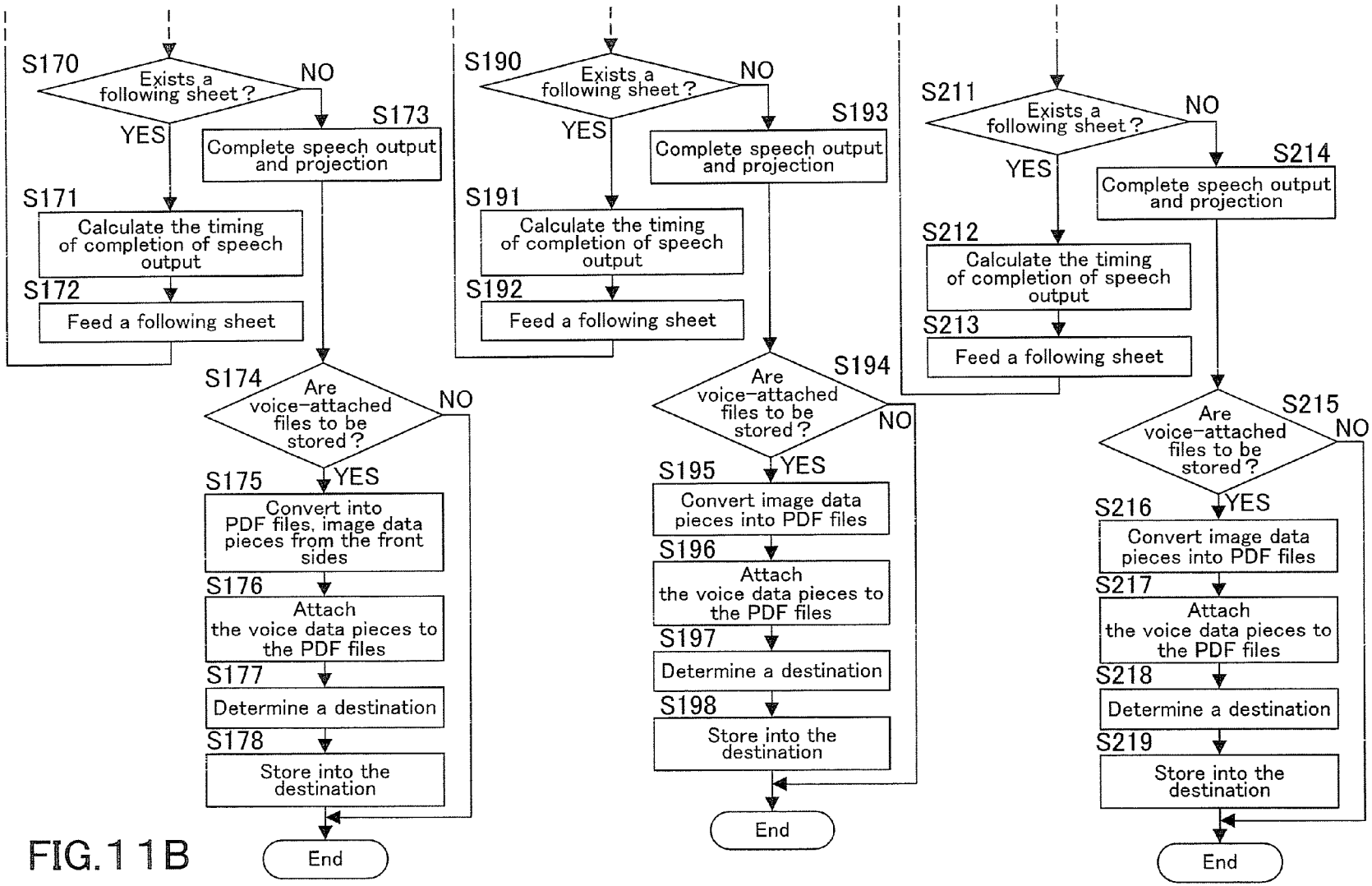

Meanwhile, if the "speech output mode" button is pressed in Step S102 (NO in Step S102), then it is judged in Step S161 of FIG. 11, whether or not the "both sides at one time" button is pressed in the speech output mode setting screen 402.

If the "both sides at one time" button is pressed (YES in Step S161), a speech output speed that is selected by user via the speech output speed setting screen 403, is determined in Step S162. Then a sheet feed speed of the automatic document feeder 17 is calculated based on the determined speech output speed, in Step S163.

Subsequently, a front side of a sheet being fed at the calculated sheet feed speed is read in Step S164, and a back side of the sheet is further read in Step S165. And a character-recognition process is performed about image data read out from the back side, in Step S166, and text data extracted by the character-recognition process is converted into voice data in Step S167.

In Step S168, image data read out from the front side is outputted to the projector 8 as projection data. After that, in Step S169, the voice data is outputted to the speaker 311 and speech is outputted at the speech output speed determined in Step S162. Then the routine proceeds to Step S170.

In Step S170, it is judged whether or not the document has a following sheet. If the document has a following sheet (YES in Step S170), the timing of completion of speech currently being outputted by the speaker 311 is calculated in Step S171. Then in Step S172, a following sheet of the document is fed by the automatic document feeder 17, so that images on the sheet could be read and projected by the projector 8 at the timing of completion of the speech. After that, the routine goes back to Step S164 and repeats Steps S164 through S172.

If the document does not have any following sheet in Step S170 (NO in Step S170), it is judged that speech output and projection are completed in Step S173. Then in Step S174, it is judged whether or not voice-attached files are to be stored, according to the setting specified via the voice-attached file destination setting screen 405.

If voice-attached files are not to be stored (NO in Step S174), the routine is immediately terminated. If those are to be stored (YES in Step S174), the image data piece(s) read out from the front side(s) of the document having one or more than one sheet(s) is (are) converted into a PDF file(s) in Step S175. And the voice data piece(s) connected thereto is (are) attached to the PDF file(s) to make into a voice-attached file(s), in Step S176. Then a destination to store the voice-attached file(s), which is entered by user via the voice-attached file destination setting screen 405, is determined in Step S177. Then in Step S178, the voice-attached file(s) is (are) stored into the destination.

Meanwhile, if the "both sides at one time" button is not pressed in Step S161 (NO in Step S161), then it is judged whether or not the "single side" button is pressed in Step S181.

If the "single side" button is pressed (YES in Step S181), a speech output speed that is selected by user via the speech output speed setting screen 403, is determined in Step S182. Then a sheet feed speed of the automatic document feeder 17 is calculated based on the determined speech output speed, in Step S183.

Subsequently, one side of a sheet being fed at the calculated sheet feed speed is read in Step S184, and an area judgment process is performed about image data read out therefrom and thus a text portion is extracted therefrom in Step S185.

A character-recognition process is performed about the extracted text portion in Step S186, and text data obtained by the character-recognition process is converted into voice data in Step S187.

In Step S188, the image data read out from the sheet is outputted to the projector 8 as projection data. After that, in Step S189, the voice data is outputted to the speaker 311 and speech is outputted at the speech output speed determined in Step S182. Then the routine proceeds to Step S190.

In Step S190, it is judged whether or not the document has a following sheet. If the document has a following sheet (YES in Step S190), the timing of completion of speech currently being outputted by the speaker 311 is calculated in Step S191. Then in Step S192, a following sheet of the document is fed by the automatic document feeder 17, so that images on the sheet could be read and projected by the projector 8 at the timing of completion of the speech. After that, the routine goes back to Step S184 and repeats Steps S184 through S192.

If the document does not have any following sheet (NO in Step S190), it is judged that speech output and projection are completed in Step S193. Then in Step S194, it is judged whether or not voice-attached file are to be stored, according to the setting.

If voice-attached files are not to be stored (NO in Step S194), the routine is immediately terminated. If those are to be stored (YES in Step S194), the image data piece(s) read out from the document having one or more than one sheet(s) is (are) converted into a PDF file(s) in Step S195. And the voice data piece(s) connected thereto is (are) attached to the PDF file(s) to make into a voice-attached file(s), in Step S196. Then a destination to store the voice-attached file(s), which is entered by user via the voice-attached file destination setting screen 405, is determined in Step S197. Then in Step S198, the voice-attached file(s) is (are) stored into the destination.

Meanwhile, if the "single side" button is not pressed in Step S181 (NO in Step S181), it is judged that the "both sides one by one" button is pressed. And a speech output speed that is selected by user via the speech output speed setting screen 403, is determined in Step S201. Then a sheet feed speed of the automatic document feeder 17 is calculated based on the determined speech output speed, in Step S202.

Subsequently, a front side of a sheet being fed at the calculated sheet feed speed is read in Step S203, and an area judgment process is performed about image data read out therefrom and thus a text portion is extracted therefrom in Step S204.

A character-recognition process is performed about the extracted text portion in Step S205, and text data obtained by the character-recognition process is converted into voice data in Step S206.

In Step S207, the image data read out from the front side is outputted to the projector 8 as projection data. After that, in Step S208, the voice data is outputted to the speaker 311 and speech is outputted at the speech output speed determined in Step S201. Then the routine proceeds to Step S209.

In Step S209, a back side of the sheet is read; an area judgment process is performed; a character recognition process is performed about a text portion; and extracted text data is converted into voice data. Then in Step S210, after output of the speech about images on the front side is completed, image data and voice data originating from the back side are outputted to the projector 8 and the speaker 311, respectively. Then the routine proceeds to Step S211.

In Step S211, it is judged whether or not the document has a following sheet. If the document has a following sheet (YES in Step S211), the timing of completion of speech currently being outputted by the speaker 311 is calculated in Step S212. Then in Step S213, a following sheet of the document is fed by the automatic document feeder 17, so that images on a front side of the sheet could be read and projected by the projector 8 at the timing of completion of the speech. After that, the routine goes back to Step S203 and repeats Steps S203 through S213.

If the document does not have any following sheet in Step S211 (NO in Step S211), it is judged that speech output and projection are completed in Step S214. Then in Step S215, it is judged whether or not voice-attached files are to be stored, according to the setting.

If voice-attached files are not to be stored (NO in Step S215), the routine is immediately terminated. If those are to be stored (YES in Step S215), the image data pieces read out from both the front and back sides of the document having one or more than one sheet(s) are converted into PDF files in Step S216. And the voice data pieces connected thereto are attached to the PDF files to make into voice-attached files, in Step S217. Then a destination to store the voice-attached files, which is entered by user via the voice-attached file destination setting screen 405, is determined in Step S218. Then in Step S219, the voice-attached files are stored into the destination.

Figure 12:
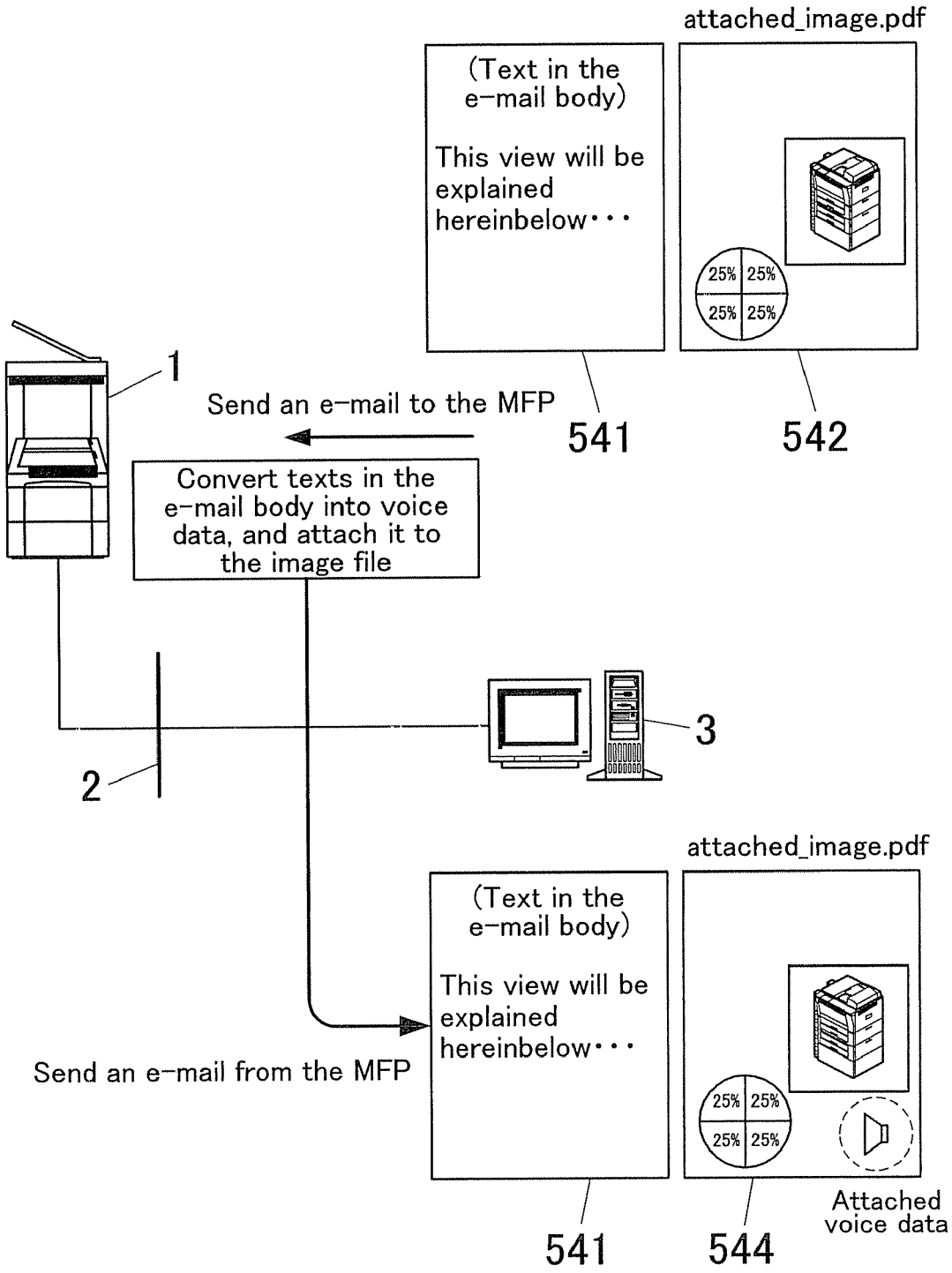
FIG. 12 is a view to explain another embodiment of the present invention.

FIG. 12 is a view to explain another embodiment of the present invention. In this embodiment, a voice-attached file is created based on an e-mail received by the image forming apparatus 1.

Initially, the image forming apparatus 1 receives an e-mail. This e-mail includes an image file 542 that is a PDF file attached thereto and an e-mail body 541 that is an explanation of the attached image file.

Receiving this e-mail, the image forming apparatus 1 converts text data of the e-mail body into voice data, then attaches the voice data to the image file 542 that is received as an attachment of the e-mail, to make into a voice-attached file 544.

Subsequently, the image forming apparatus 1 attaches the voice-attached file 544 to the e-mail body 541 and returns this by e-mail to the e-mail sender. Instead of transmitting this by e-mail, the image forming apparatus 1 may store this into a predetermined destination.

Figure 13:
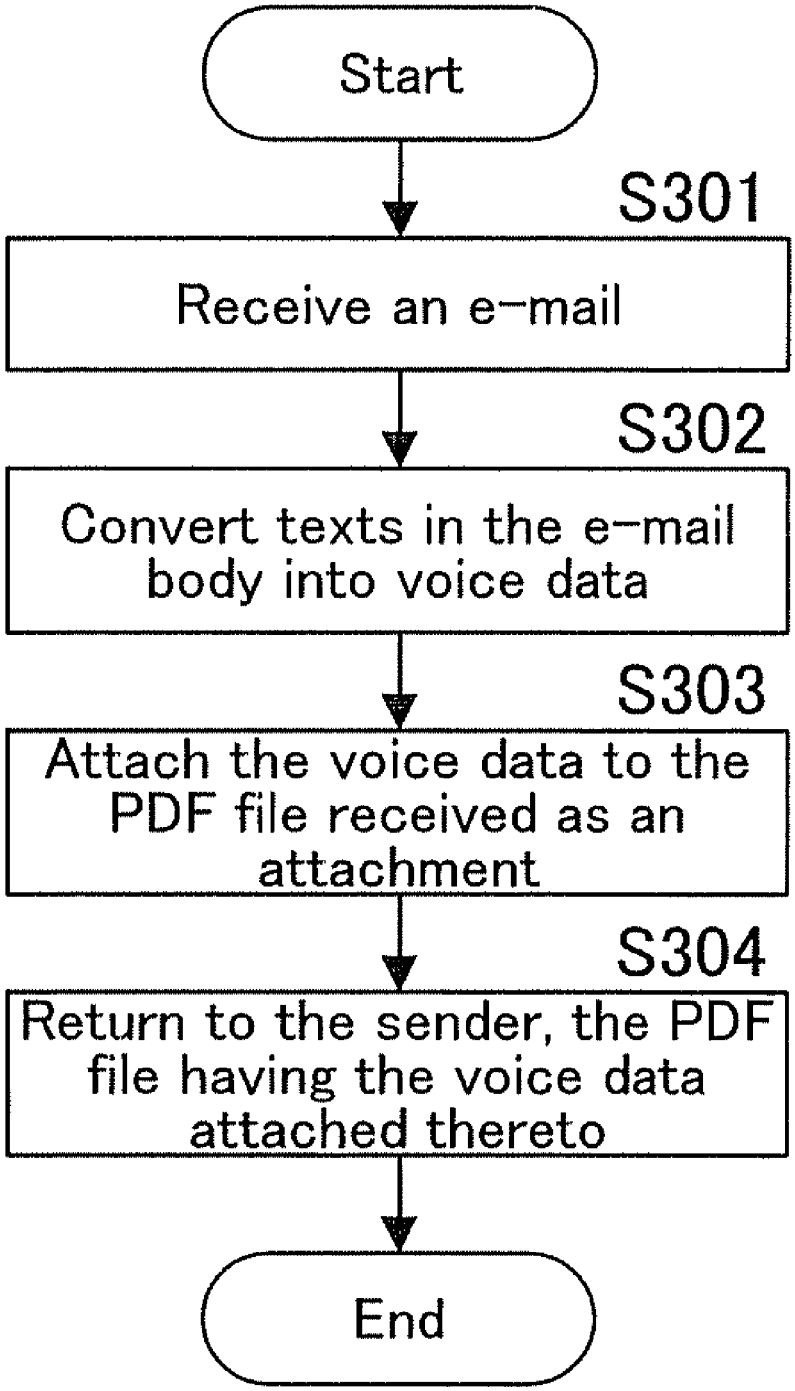
FIG. 13 is a flowchart showing a procedure executed in the image forming apparatus, which is explained with FIG. 12.

FIG. 13 is a flowchart showing a procedure executed in the image forming apparatus 1, which is explained with FIG. 12. This procedure is executed by the CPU 3011 according to an operation program recorded in a recording medium such as the ROM 3013.

In Step S301, the image forming apparatus 1 receives an e-mail. Then text data of the e-mail body is converted into voice data in Step S302, and the obtained voice data is attached to a PDF file that is received as an attachment of the e-mail, to make into a voice-attached file, in Step S303. Then the voice-attached file (the PDF file having the voice data attached thereto) is returned by e-mail in Step S304.

As described above in this embodiment, a voice-attached file having image data and voice data connected to each other can be created by using the image data and the text data received by e-mail.

Figure 14:
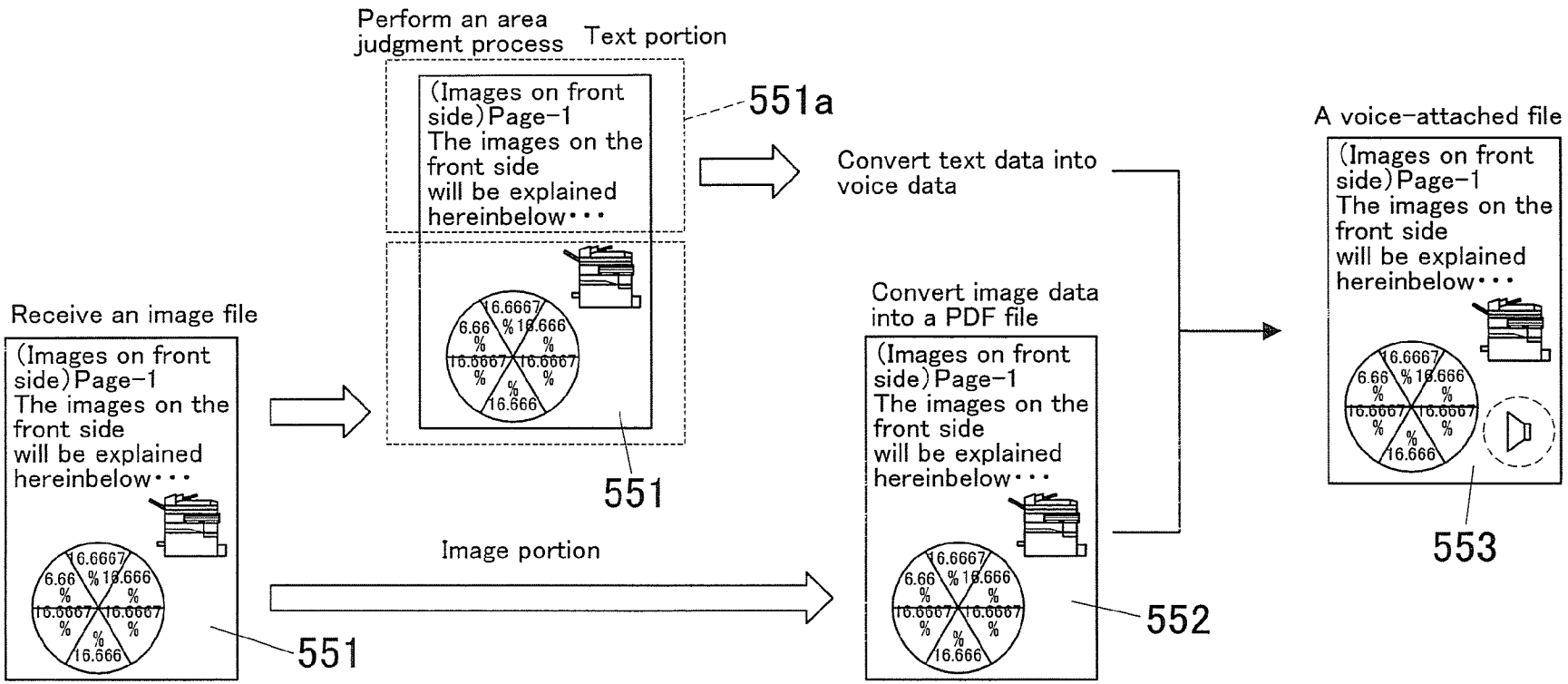
FIG. 14 is a view to explain yet another embodiment of the present invention.

FIG. 14 is a view to explain yet another embodiment of the present invention. In this embodiment, a voice-attached file is created based on an image file received from an external apparatus such as the client terminal 3.

Initially, the image-forming apparatus 1 receives an image file 551. This image file 551 includes an image portion and a text portion.

Receiving the image file 551, the image forming apparatus 1 performs an area judgment process and thus extracts a text portion 551*a* therefrom; performs a character-recognition process about the text portion 551*a;* and converts the obtained text data into voice data.

Meanwhile, the received image file 551 is converted into a PDF file 552. After that, the obtained voice data is attached to the PDF file 552 to make into a voice-attached file 553.

The created voice-attached file 553 may be stored into a predetermined destination or returned to the sender.

Figure 15:
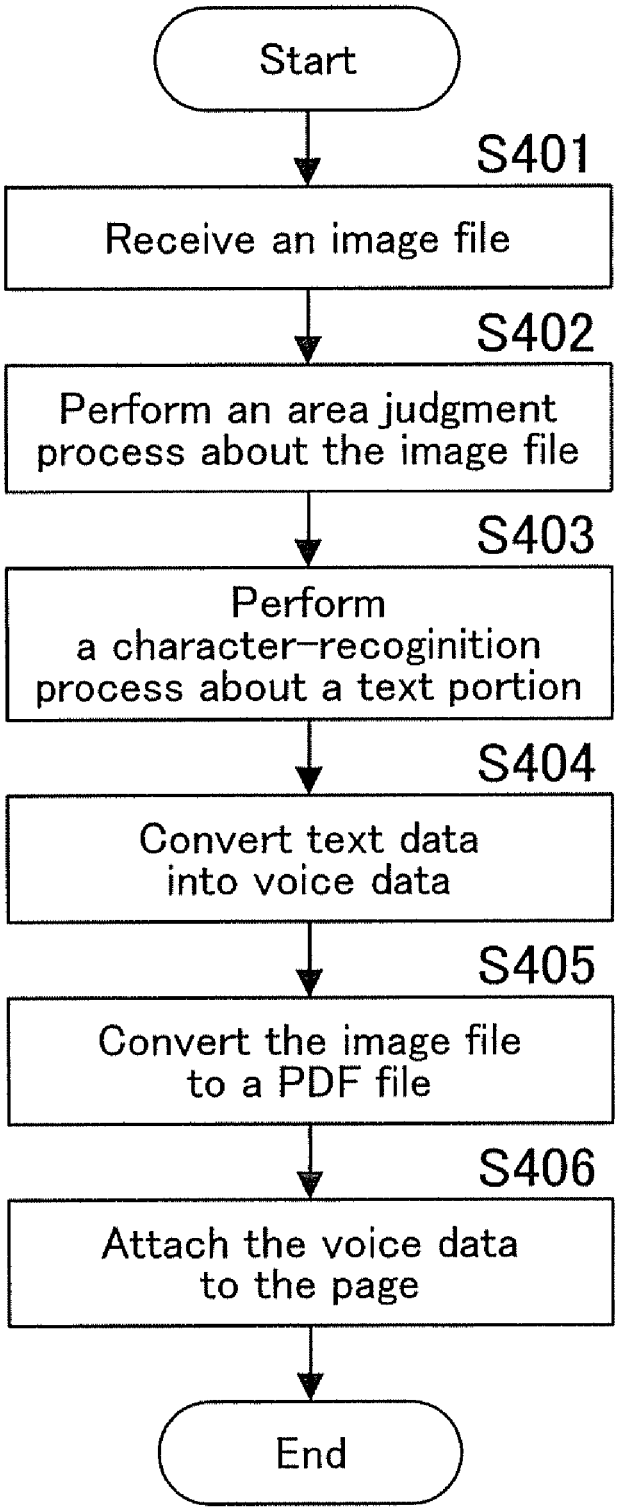
FIG. 15 is a flowchart showing a procedure executed in the image forming apparatus, which is explained with FIG. 13.

FIG. 15 is a flowchart showing a procedure executed in the image forming apparatus 1, which is explained with FIG. 14. This procedure is executed by the CPU 3011 according to an operation program recorded in a recording medium such as the ROM 3013.

In Step S401, the image forming apparatus 1 receives an image file 551. Then an area judgment process is performed about the image file and thus a text portion is extracted therefrom in Step S402, and a character-recognition process is performed about the extracted text portion in Step S403.

Subsequently, text data obtained by the character-recognition process is converted into voice data in Step S404. Meanwhile, the image file 551 is converted into a PDF file 552 in Step S405. After that, the voice data is attached to the PDF file 552 to make into a voice-attached file 553.

If the image file has a plurality of pages, this procedure is repeatedly executed about the respective pages.

As described above in this embodiment, a voice-attached file having image data and voice data connected to each other can be created by using an image file received from an external apparatus.

Figure 16:
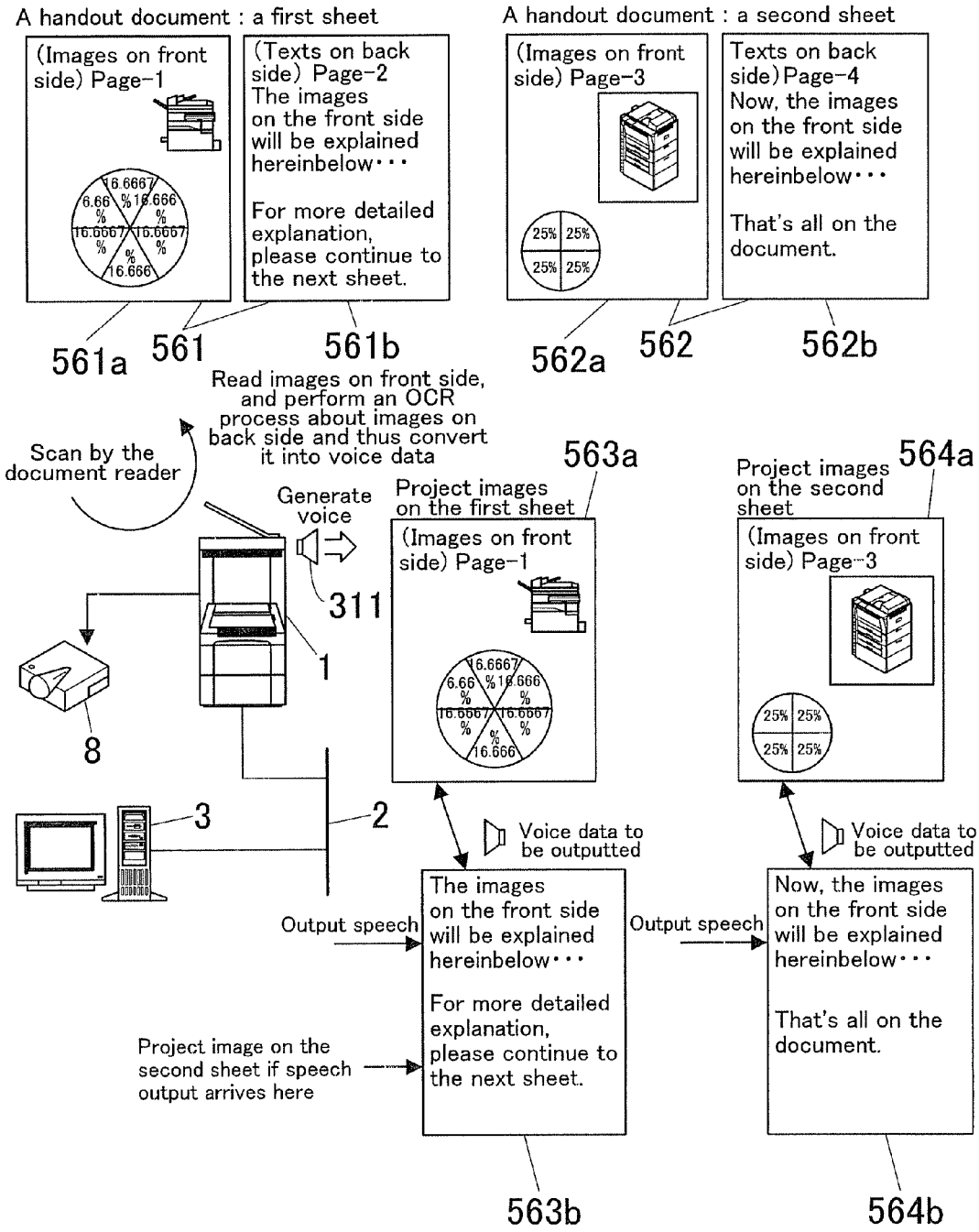
FIG. 16 is a view to explain still yet another embodiment of the present invention.

FIG. 16 is a view showing still yet another embodiment of the present invention. In this embodiment, if completion of speech about images on one page or a predetermined partition of voice data is detected, image data read out from a following page is started to be outputted to the projector 8.

In this example, a plurality of sheets (a document) that are a first sheet 561 and a second sheet 562 having images printed on their front sides and texts printed on their back sides, respectively, should be prepared. Concretely, for example in this embodiment, images are printed on a front side 561*a* (Page 1) of the first sheet 561, texts to explain the images of Page 1 are printed on a back side 561*b* (Page 2) thereof, images are printed on a front side 562*a* (Page 3) of the second sheet 562, and texts to explain the images of Page 3 are printed on a back side 562*b* (Page 4) thereof.

If the "speech output mode" button is pressed in the mode selection screen 401 not shown in Figure and the "both sides at one time" button is further pressed in the speech output mode setting screen 402 and then a speech output speed is selected in the speech output speed setting screen 403, the sheets 561 and 562 are sequentially conveyed to a reading position of the document reader 305. Then, the images on the front sides 561*a* and 562*a* and the texts on the back sides 561*b* and 562*b* are read at one time.

A character-recognition process is performed by the character-recognition processor 20 about the texts on the back sides 561*b* and 562*b* and thus those are converted into text data. And then, it is further converted into voice data. The obtained voice data pieces originating from the back sides are connected to image data 563*a* read out from the front side 561*a* and image data 564*a* read out from the front side 562*a*, respectively.

The image data 563*a* read out from the front side of the first sheet is outputted to the projector 8 then projected on a screen or etc. by the projector 8. Meanwhile, the voice data 563*b* connected to the image data 563*a* is outputted to the speaker 311 then speech is outputted accordingly. And thus, explanation about the images displayed on a screen or etc. is automatically given by voice.

If completion of the speech about the images on the first sheet or a predetermined partition is detected, the image data read out from the second sheet is outputted to the projector 8. In this example, the voice data is terminated with ". . . will be explained with the document" and if this tail end is completely outputted by the speaker 311, in other words, if speech output is completed, a following image data piece is outputted to the projector 8 then projected on a screen or etc. If the voice data is not terminated with ". . . will be explained with the document" it can be configured such that this string itself is detected as a predetermined partition and a following image data piece is outputted to the projector 8.

If a following image data piece is outputted to the projector 8, the voice data connected to the image data piece is outputted to the speaker 311 then speech is outputted accordingly.

And thus, output of speech about the images on all the sheets is completed. If it is judged that voice-attached files are not to be stored, according to the setting, the routine is immediately terminated. If it is judged that voice-attached files are to be stored, according to the setting, the image data pieces read out from the front sides of the respective sheets are converted into PDF files, for example. And the voice data pieces connected thereto, originating from the back sides thereof, are attached to the PDF files to make into voice-attached files, then those are stored into a determined destination.

As described above, if there exists image data read out from a plurality of pages and completion of output of voice data connected to image data read out from one page or a partition of the voice data is detected, image data read out from a following page is started to be outputted to a display apparatus. In this way, images on the respective pages can be displayed sequentially, and speech about the images can be outputted smoothly.

Hereinafter, a procedure executed in the image forming apparatus 1 will be represented by a flowchart shown in FIG. 17, in which if completion of speech about one page or a partition is detected, image data read out from a following page is output to the projector 8 then output speech, as explained with FIG. 16. This flowchart corresponds to that of FIG. 11 and is continued to that of FIG. 9.

This procedure is executed by the CPU 3011 of the main circuit 301, according to an operation program recorded in a recording medium such as the ROM 3013.

Figure 17A:
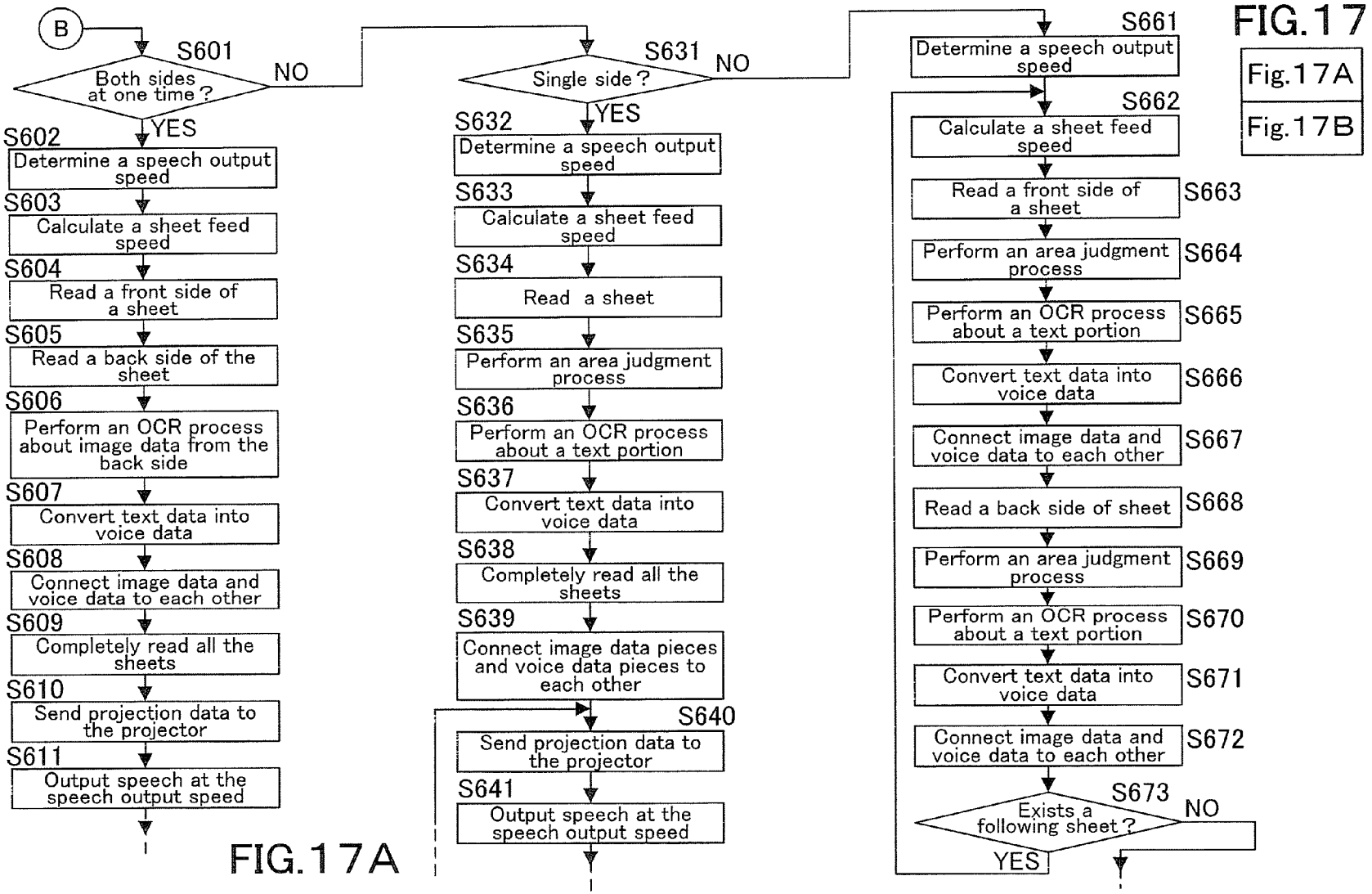
FIG. 17 is a flowchart showing a procedure executed in the image forming apparatus, in which if completion of speech about one page or a partition is detected, image data read out from a following page is outputted to a projector and speech is outputted accordingly.
Figure 17B:
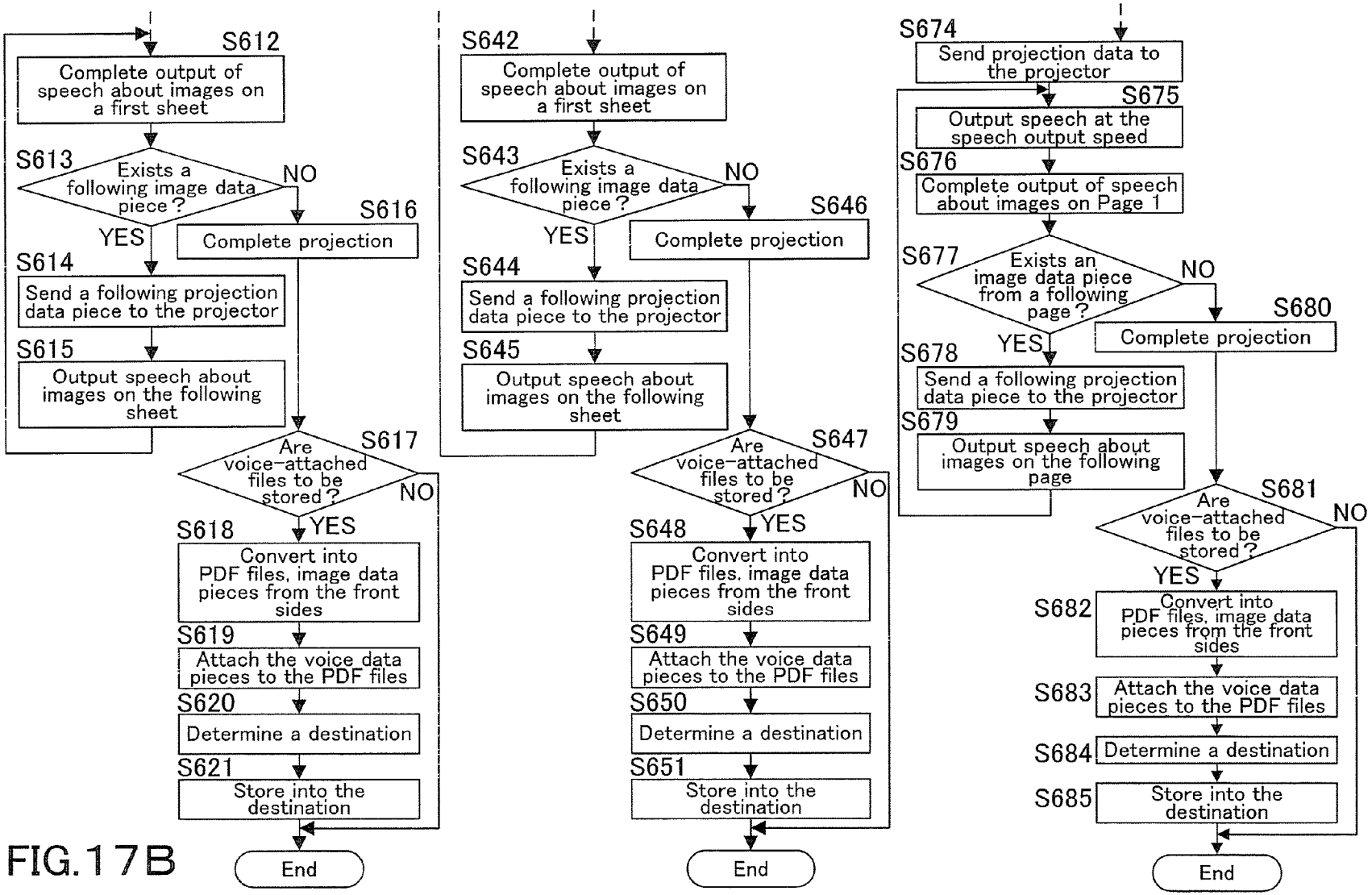

In Step S601 of FIG. 17, it is judged whether or not the "both sides at one time" button is pressed in the speech output mode setting screen 402.

If the "both sides at one time" button is pressed (YES in Step S601), a speech output speed that is selected by user via the speech output speed setting screen 403, is determined in Step S602. Then a sheet feed speed of the automatic document feeder 17 is calculated based on the determined speech output speed, in Step S603.

Subsequently, a front side of a sheet being fed at the calculated sheet feed speed is read in Step S604, and a back side thereof is further read in Step S605. And a character-recognition process is performed about image data read out from the back side, in Step S606, and text data extracted by the character-recognition process is converted into voice data in Step S607. Then the voice data and the image data are connected to each other in Step S608.

The routine repeats Steps S604 through S608 as many times as the number of sheets.

In Step S609, it is judged that all the sheets are completely read. And an image data piece read out from the first sheet is outputted to the projector 8 as projection data, in Step S610. After that, in Step S611, the voice data piece connected to the image data piece read out from the first sheet is outputted to the speaker 311 and speech is outputted at the speech output speed determined in Step S602.

In Step S612, output of the speech based on the voice data piece connected to the image data piece read out from the first sheet is completed. Then it is judged in Step S613 whether or not there exists a following image data piece. If there exists a following image data piece (YES in Step S613), the following image data piece is outputted to the projector 8 as projection data in Step S614. After that, in Step S615, the voice data piece connected to the image data piece is outputted to the speaker 311 and speech is outputted accordingly. Then the routine goes back to Step S612.

The routine repeats Steps S612 through S615 until there does not exist any following image data piece. If there does not exist any following image data piece (NO in Step S613), it is judged that projection is completed in Step S616, then it is judged in Step S617 whether or not voice-attached files are to be stored, according to the setting.

If voice-attached files are not to be stored (NO instep S617), the routine is immediately terminated. If those are to be stored (YES in Step S617), the image data pieces read out from the front sides of the respective sheets are converted into PDF files in Step S618, and the voice data pieces connected thereto are attached to the PDF files to make into voice-attached files. Then a destination to store the voice-attached files, which is entered by user via the voice-attached file destination setting screen 405, is determined in Step S620. Then in Step S621, the voice-attached files are stored into the destination.

Meanwhile, if the "both sides at one time" button is not pressed in Step S601 (NO in Step S601), then it is judged in Step S631 whether or not the "single side" button is pressed.

If the "single side" button is pressed in Step S631 (YES in Step S631), a speech output speed that is selected by user via the speech output speed setting screen 403, is determined in Step S632. Then a sheet feed speed of the automatic document feeder 17 is calculated based on the determined speech output speed, in Step S633.

Subsequently, images on a sheet being fed at the calculated sheet feed speed is read in Step S634, and an area judgment process is performed about obtained image data and thus a text portion is extracted therefrom in Step S635.

And a character-recognition process is performed about the extracted text portion in Step S636, and text data extracted by the character-recognition process is converted into voice data in Step S637.

The routine repeats Steps S634 through S637 as many times as the number of sheets.

In Step S638, it is judged that all the sheets are completely read. And the image data pieces read out from the respective sheets and the voice data pieces extracted from the respective image data pieces are connected to each other in Step S639, and the image data piece read out from the first sheet is outputted to the projector 8 as projection data, in Step S640. After that, in Step S641, the voice data piece connected thereto is outputted to the speaker 311 and speech is outputted at the speech output speed determined in Step S632.

In Step S642, output of the speech based on the voice data piece connected to the image data piece read out from the first sheet is completed. Then it is judged in Step S643 whether or not there exists a following image data piece. If there exits a following image data piece (YES in Step S643), the following image data piece is outputted to the projector 8 as projection data, in Step S644. After that, in Step S645, the voice data piece connected to the image data piece is outputted to the speaker 311 and speech is outputted accordingly. Then the routine goes back to Step S642.

The routine repeats Steps S642 through S645 until there does not exist a following image data piece. If there does not exist a following image data piece (NO in Step S643), it is judged that projection is completed in Step S646, then it is judged in Step S647 whether or not voice-attached files are to be stored, according to the setting.

If voice-attached files are not to be stored (NO in Step S647), the routine is immediately terminated. If those are to be stored (YES in Step S647), the image data pieces read out from the respective sheets are converted into PDF files in Step S648. And the voice data pieces connected thereto are attached to the PDF files to make into voice-attached files, in Step S649. Then a destination to store the voice-attached files, which is entered by user via the voice-attached file destination setting screen 405, is determined in Step S650. Then in Step S651, the voice-attached files are stored into the destination.

Meanwhile, if the "single side" button is not pressed in Step S631 (NO in Step S631), then it is judged that the "both sides one by one" button is pressed. And a speech output speed that is selected by user via the speech output speed setting screen 403, is determined in Step S661. Then a sheet feed speed of the automatic document feeder 17 is calculated based on the determined speech output speed, in Step S662.

Subsequently, a front side of a first sheet being fed at the calculated sheet feed speed is read in Step S663, and an area judgment process is performed about obtained image data and thus a text portion is extracted therefrom in Step S664.

A character-recognition process is performed about the extracted text portion in Step S665, and text data obtained by the character-recognition process is converted into voice data in Step S666, and then the image data piece and the voice data piece are connected to each other in Step S667.

Subsequently, a back side of the first sheet is read in Step S668, and an area judgment process is performed about obtained image data and thus a text portion is extracted therefrom in Step S669. Then a character-recognition process is performed about the extracted text portion in Step S670, and text data obtained by the character-recognition process is converted into voice data in Step S671, and then the image data and the voice data are connected to each other in Step S672.

In Step S673, it is judged whether or not there the document has a following sheet. If the document has a following sheet (YES in Step S673), the routine goes back to Step S662 and repeats Steps S662 through S673. If the document does not have any following sheet (NO in Step S673), the routine proceeds to Step S674.

In Step S674, the image data piece read out from the first page is outputted to projector 8 as projection data. After that, in Step S675, the voice data piece connected to the image data piece is outputted to the speaker 311 and speech is outputted at the speech output speed determined in Step S661.

In Step S676, output of the speech based on the voice data piece is completed. Then it is judged in Step S677 whether or not there exists an image data piece read out from a following page. If there exists an image data piece read out from a following page (YES in Step S677), the image data piece is outputted to the projector 8 as projection data in Step S678. After that, in Step S679, the voice data piece connected to the image data piece is outputted to the speaker 311 and speech is outputted accordingly. Then the routine goes back to Step S676.

The routine repeats Steps S676 through S679 until there does not exist any image data piece read out from a following page. If there does not exist any image data piece read out from a following page (NO in Step S677), it is judged that projection is completed in Step S680, then it is judged in Step S681 whether or not voice-attached files are to be stored, according to the setting.

If voice-attached files are not to be stored (NO in Step S681), the routine is immediately terminated. If those are to be stored (YES in Step S681), the image data pieces read out from the respective pages are converted into PDF files in Step S682. And the voice data pieces connected thereto are attached to the PDF files to make into voice-attached files, in Step S683. Then a destination to store the voice-attached files, which is entered by user via the voice-attached file destination setting screen 405, is determined in Step S684. Then in Step S685, the voice-attached files are stored into the destination.

Figure 18:
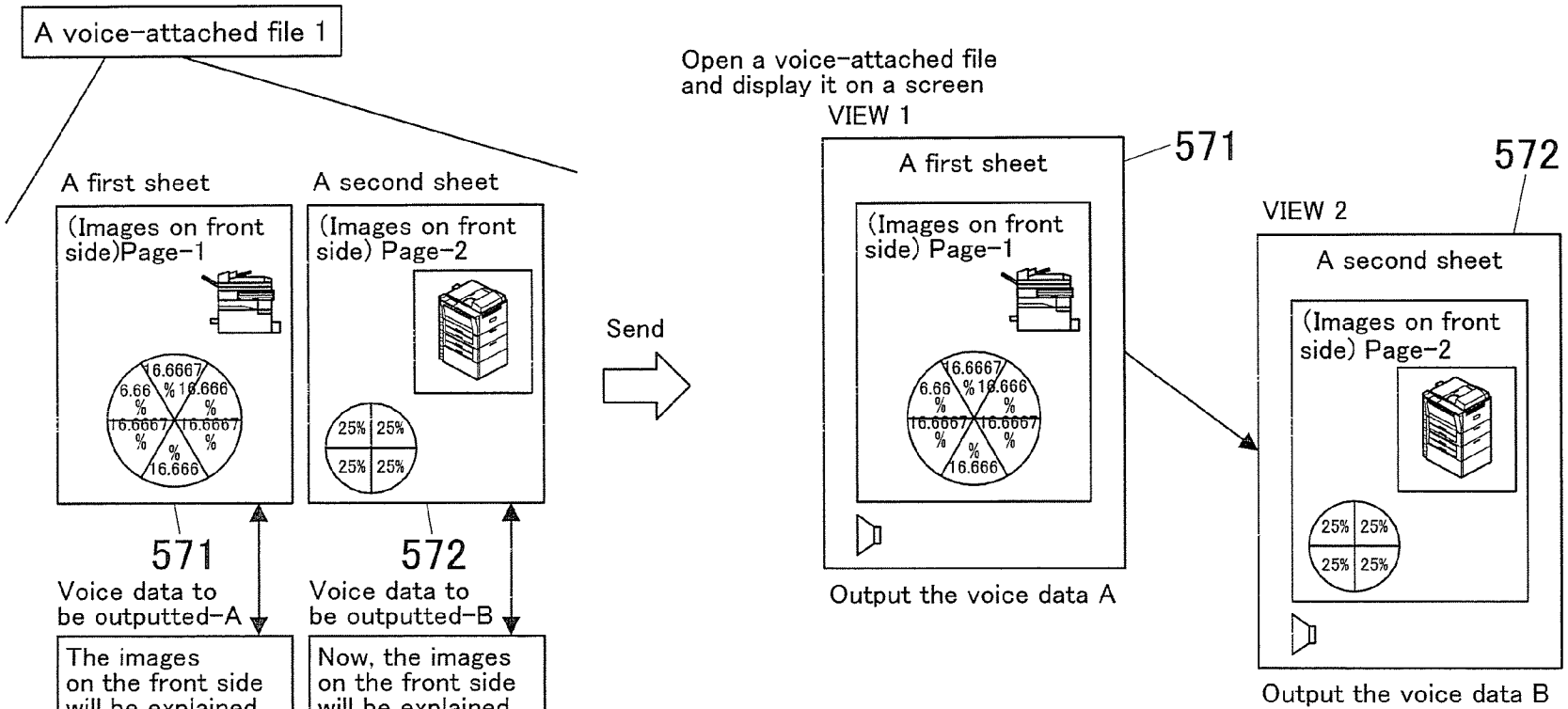
FIG. 18 is a view to explain further still yet another embodiment of the present invention.

FIG. 18 is a view showing further still yet another embodiment of the present invention. In this embodiment, if a voice-attached file, which is received from an external apparatus such as the client terminal 3 then stored in a Box that is a memory area of the memory 3016, is opened according to user operation performed via the operation panel 10 of the image forming apparatus 1, image data is displayed on the display 12 and voice data connected thereto is outputted by the speaker 311.

Initially, an exclusive application program to display image data and output speech should be installed on the image forming apparatus 1.

As shown in FIG. 18, a voice-attached file 570 is transmitted to the image forming apparatus 1 from the client terminal 3. The voice-attached file 570 includes a PDF file having image data 571 read out from a first sheet, with attached voice data 573 connected to the image data 571, and a PDF file having image data 572 read out from a second sheet, with attached voice data 574 connected to the image data 572.

Receiving the voice voice-attached file 570, the image forming apparatus 1 stores the file into a predetermined Box of the memory 3016.

If a user opens on the display 12, Page 1 of the voice-attached file (a PDF file having voice data attached thereto) stored therein, the exclusive application program is activated. And the voice data 573 connected thereto is outputted to the speaker 311 then speech is outputted by the speaker 311.

If speech output is completed, the image data 572 read out from Page 2 is displayed on the display 12 and speech about Page 2 is outputted by the speaker 311.

In this way, images on a plurality of pages are displayed on the display 12 sequentially, and speech about the images is outputted by the speaker 311.

Figure 19:
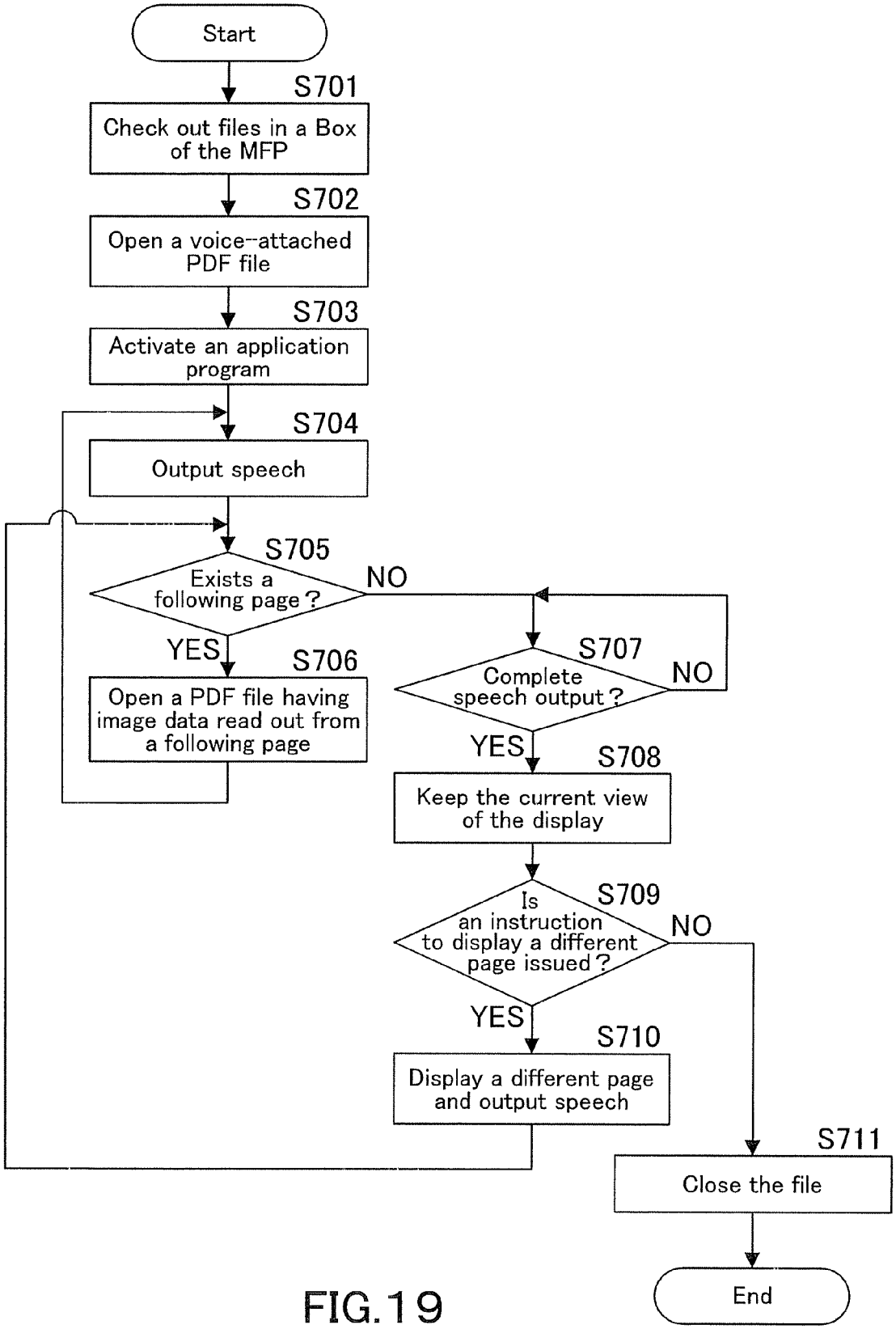
FIG. 19 is a flowchart showing a procedure executed in the image forming apparatus, which is explained with FIG. 18.

FIG. 19 is a flowchart showing a procedure executed in the image forming apparatus 1, which is explained with FIG. 18. This procedure is also executed by the CPU 3011 according to a program recorded in a recording medium such as the ROM 3013.

In Step S701, files stored in a Box of the memory 3016 are checked out via the operation panel 10, and a voice-attached file (a PDF file having voice data attached thereto) is opened in Step S702. Then, the exclusive application program is activated in Step S703, and speech is outputted in Step S704.

When speech output is completed, it is judged in Step S705, whether or not there exists a following page. If there exists a following page (YES in Step S705), a PDF file having image data read out from the following page is opened in Step S706. Then the routine goes back to Step S704 and repeats Steps S704 through S706 until there does not exist any following page.

If there does not exist any following page (NO in Step S705), then it is judged in Step S707 whether or not speech output is completed. If it is not completed (NO in Step S707), the routine waits until it is completed. If it is completed (YES in Step S707), the current state of the display is kept as is in Step S708. And it is judged in Step S709 whether or not an instruction to display a different page is issued.

If an instruction to display a different page is issued (YES in Step S709), images on that page is displayed and speech is outputted accordingly, in Step S710. Then the routine proceeds to Step S705. If an instruction to display a different page is not issued (NO in Step S709), the voice-attached file is closed in Step S711.

Figure 20:
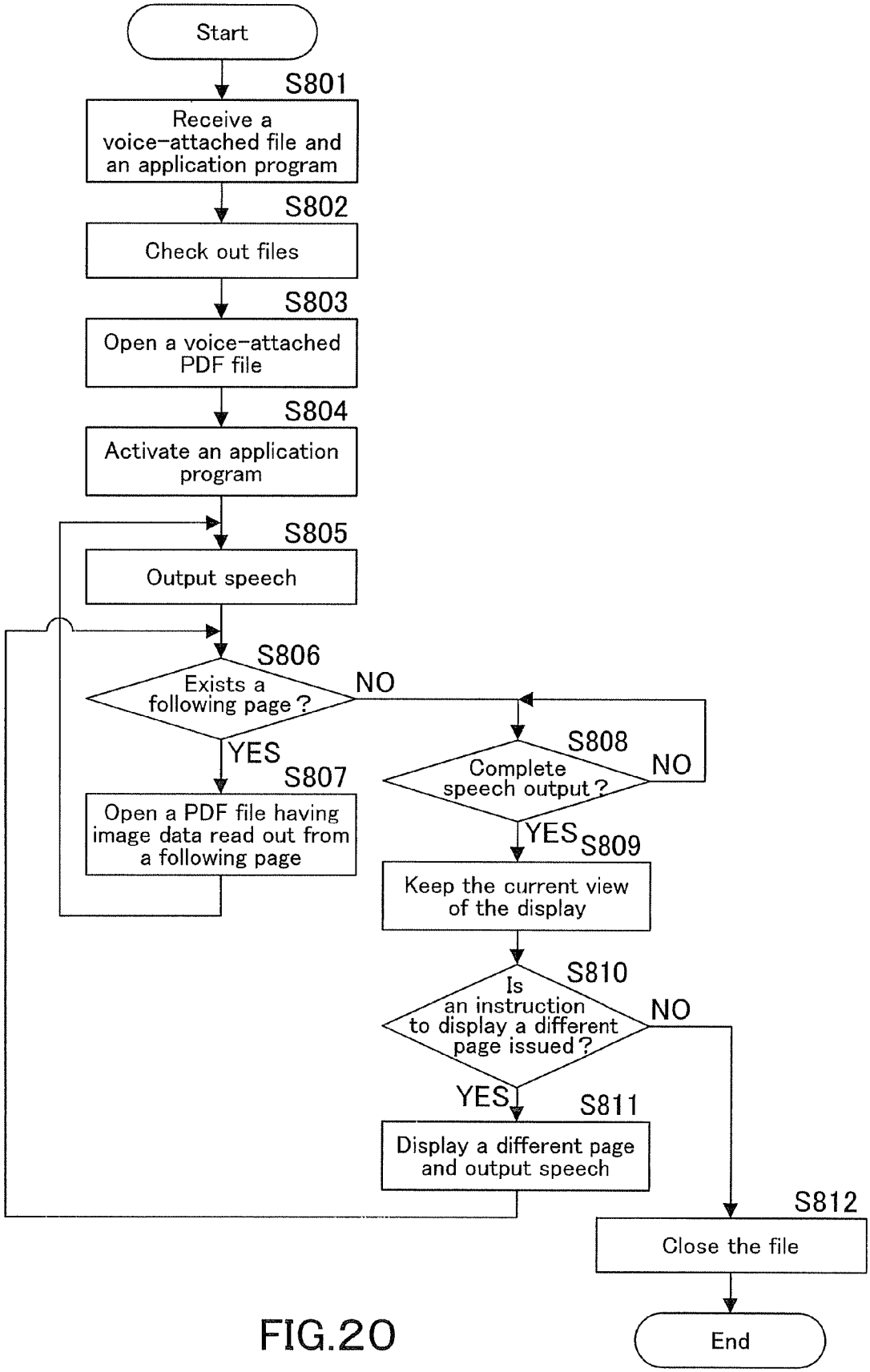
FIG. 20 is a flowchart showing a procedure executed in a client terminal, if a voice-attached file stored in the client terminal is opened.

FIG. 20 is a flowchart showing a procedure executed in the client terminal 3, if a voice-attached file stored in the client terminal 3 is opened.

In Step S801, a voice-attached file (a PDF file having voice data attached thereto) and an application program to display image data and output speech) are received from the image forming apparatus 1, and then the voice-attached file is recorded in a memory and the application program is installed on the client terminal.

Subsequently, files stored in the memory are checked out via the operation portion such as a keyboard in Step S802, and a voice-attached file is opened in Step S803. Then, the application program is activated in Step S804, and speech is outputted accordingly in Step S805.

When speech output is completed, it is judged in Step S806, whether or not there exists a following page. If there exists a following page (YES in Step S806), a PDF file having image data read out from the following page is opened in Step S07. Then the routine goes back to Step S805 and repeats Steps S805 through S807 until there does not exist any following page.

If there does not exist any a following page (NO in Step S806), then it is judged in Step S808 whether or not speech output is completed. If it is not completed (NO in Step S808), the routine waits until it is completed. If it is completed (YES in Step S808), the current state of the display is kept as is in Step S809. And it is judged in Step S810 whether or not an instruction to display a different page is issued.

If an instruction to display a different page is issued (YES in Step S810), images on that page is displayed and speech is outputted accordingly, in Step S811. Then the routine proceeds to Step S806. If an instruction to display a different page is not issued (NO in Step S709), the voice-attached file is closed in Step S812.

Hereinabove, some embodiments of the present invention has been described. However, the present invention is not limited to these embodiments. For example, image data is converted into a PDF file and voice data is attached to the PDF file, and thus the image data and the voice data are connected to each other. Instead of a PDF file, image data may be converted into a different format file that is capable of having voice data as an attachment. Furthermore, voice data may be connected to image data without being attached to a PDF file or another file.

Furthermore, in these embodiments, the image forming apparatus 1 creates voice-attached files. Alternatively, the client terminals may create voice-attached files.

While the present invention may be embodied in many different forms, a number of illustrative embodiments are described herein with the understanding that the present disclosure is to be considered as providing examples of the principles of the invention and such examples are not intended to limit the invention to preferred embodiments described herein and/or illustrated herein.

While illustrative embodiments of the invention have been described herein, the present invention is not limited to the various preferred embodiments described herein, but includes any and all embodiments having equivalent elements, modifications, omissions, combinations (e.g. of aspects across various embodiments), adaptations and/or alterations as would be appreciated by those in the art based on the present disclosure. The limitations in the claims are to be interpreted broadly based on the language employed in the claims and not limited to examples described in the present specification or during the prosecution of the application, which examples are to be construed as non-exclusive. For example, in the present disclosure, the term "preferably" is non-exclusive and means "preferably, but not limited to". In this disclosure and during the prosecution of this application, means-plus-function or step-plus-function limitations will only be employed where for a specific claim limitation all of the following conditions are present In that limitation: a) "means for" or "step for" is expressly recited; b) a corresponding function is expressly recited; and c) structure, material or acts that support that structure are not recited. In this disclosure and during the prosecution of this application, the terminology "present invention" or "invention" may be used as a reference to one or more aspect within the present disclosure. The language present invention or invention should not be improperly interpreted as an identification of criticality, should not be improperly interpreted as applying across all aspects or embodiments (i.e., it should be understood that the present invention has a number of aspects and embodiments), and should not be improperly interpreted as limiting the scope of the application or claims. In this disclosure and during the prosecution of this application, the terminology "embodiment" can be used to describe any aspect, feature, process or step, any combination thereof, and/or any portion thereof, etc. In some examples, various embodiments may include overlapping features. In this disclosure and during the prosecution of this case, the following abbreviated terminology may be employed: "e.g." which means "for example", and "NB" which means "note well".

What is claimed is:

1. An image processing apparatus comprising:

an image data input portion that inputs image data;

a text data input portion that inputs text data;

a voice data converter that converts into voice data, the text data inputted by the text data input portion;

a connector that connects to each other, the voice data obtained by the voice data converter and the image data inputted by the image data input portion;

a file creator that creates a file including the image data and the voice data connected to each other by the connector;

the image data input portion and the text data input portion correspond to a reader that reads out image data by scanning a document;

the voice data converter converts into voice data, text data extracted from the image data read out from the document by the reader;

the connector connects to each other, the obtained voice data and the image data appropriate for the voice data;

the text data converted into voice data is extracted from the image data read out from one side of the document; and the voice data into which the text data is converted is connected to the image data read out from the other side of the document.

2. The image processing apparatus recited in claim 1, wherein:

the image data is comprised of image data pieces read out from a plurality of pages, and voice data pieces about the respective pages are connected to the image data pieces, and further comprising:

an output portion that outputs the image data pieces to a display apparatus and outputs the voice data pieces to a speech output apparatus, and wherein:

the output portion starts outputting to the speech output apparatus a voice data piece connected to an image data piece read out from one page, based on the output of the image data piece to the display apparatus, and the output portion starts outputting to the display apparatus an image data piece read out from a following page, based on the completion of outputting the voice data piece.

3. The image data processing apparatus recited in claim 1, wherein:

the image data is comprised of image data pieces read out from a plurality of pages, and voice data pieces about the respective pages are connected to the image data pieces, and further comprising:

an output portion that outputs the image data pieces to a display apparatus and outputs the voice data pieces to a speech output apparatus, and wherein:

the output portion starts outputting to the speech output apparatus a voice data piece connected to an image data piece read out from one page, based on the output of the image data piece to the display apparatus, and the output portion starts outputting to the display apparatus an image data piece read out from a following page, based on the detection of a predetermined partition of the voice data piece.

4. The image processing apparatus recited in claim 1, wherein:

the image data input portion and the text data input portion correspond to a file receiver that receives a file including image data and text data sent by an external sender;

the voice data converter that converts into voice data, text data included in a file received by the file receiver; and the connector connects the obtained voice data and the image data to each other.

5. The image processing apparatus recited in claim 4, wherein:

the file receiver corresponds to an e-mail receiver;

the voice data converter converts into voice data, texts in the e-mail body of an e-mail having the image data as an e-mail attachment, received by the e-mail receiver; and the connector connects to each other, the image data that is received as an e-mail attachment and the voice data into which the body of the e-mail is converted.

6. The image processing apparatus recited in claim 1, wherein:

the reader reads the both sides of the document at one time.

7. The image processing apparatus recited in claim 1, further comprising:

a sender that sends the file created by the file creator to an external sender.

8. The image processing apparatus recited in claim 7, wherein:

the image data input portion and the text data input portion correspond to a file receiver that receives a file including the image data and the text data appropriate for the image data, which is sent by the external sender; and the sender sends the file created by the file creator to the external sender originating the file received by the file receiver.

9. The image processing apparatus recited in claim 7, wherein:

the sender sends together with the file created by the file creator, an application program enabling an apparatus that is the external sender, to display the image data included in the file.

10. The image processing apparatus recited in claim 1 further comprising:

a memory that records in itself, a file having the image data and the voice data connected to each other, and wherein:

the output portion outputs the image data to a display apparatus and outputs the voice data connected to the image data, to a speech output apparatus, if the file recorded in the memory is opened.

11. An image processing apparatus comprising:

a reader that reads out image data by scanning a document having one or more than one sheets;

a voice data converter that converts into voice data, text data extracted from the image data read out from the document having one or more than one sheets, by the reader;

a connector that connects to each other, the voice data obtained by the voice data converter and the image data read out by the reader;

an output portion that outputs to a display apparatus, the image data connected to the voice data, to a display apparatus, and outputs the voice data to a speech output apparatus; and a conveyer that conveys the document to a reading position of the reader; and a conveyance controller that calculates the timing of completion of speech outputted by the speech output apparatus based on the voice data connected to the image data read out from one sheet of the document having a plurality of sheets, and then makes the conveyer start conveying a following sheet of the document.

12. The image processing apparatus recited in claim 11, further comprising:

a speed setting portion that is capable of variably setting the speed of the voice generated by the speech output apparatus, and wherein:

the conveyance controller changes the document feed speed of the conveyer based on the speed of the voice, which is set by the speed setting portion.

13. An image processing method comprising:

inputting image data;

inputting text data;

converting the inputted text data into voice data;

connecting the obtained voice data and the inputted image data to each other;

creating a file including the image data and the voice data connected to each other;

inputting the image data and the text data corresponds to reading out image data by scanning a document;

text data extracted from image data read out from a document is converted into voice data;

the obtained voice data and the image data appropriate for the voice data are connected to each other;

the text data converted into voice data is extracted from the image data read out from one side of the document; and the voice data into which the text data is converted is connected to the image data read out from the other side of the document.

14. The image processing method recited in claim 13, wherein:

the image data is comprised of image data pieces read out from a plurality of pages, and voice data pieces about the respective pages are connected to the image data pieces, and further comprising:

outputting the image data pieces to a display apparatus and outputting the voice data pieces to a speech output apparatus, and wherein:

the output portion starts outputting to the speech output apparatus a voice data piece connected to an image data piece read out from one page, based on the output of the image data piece to the display apparatus, and the output portion starts outputting to the display apparatus an image data piece read out from a following page, based on the completion of outputting the voice data piece.

15. The image processing method recited in claim 13, wherein:

the image data is comprised of image data pieces read out from a plurality of pages, and voice data pieces about the respective pages are connected to the image data pieces, and further comprising:

outputting the image data pieces to a display apparatus and outputting the voice data pieces to a speech output apparatus, and wherein:

the output portion starts outputting to the speech output apparatus a voice data piece connected to an image data piece read out from one page, based on the output of the image data piece to the display apparatus, and the output portion starts outputting to the display apparatus an image data piece read out from a following page, based on the detection of a predetermined partition of the voice data piece.

16. The image processing method recited in claim 13, wherein:

inputting the image data the text data corresponds to receiving a file including image data and text data sent by an external sender;

text data included in a received file is converted into voice data; and the obtained voice data and the image data are connected to each other.

17. The image processing method recited in claim 16, wherein:

receiving the file corresponds to receiving an e-mail;

texts in the e-mail body of an received e-mail having the image data as an e- mail attachment are converted into voice data; and the image data that is received as an e-mail attachment and the voice data into which the body of the e-mail is converted, are connected to each other.

18. The image processing method recited in claim 13, wherein:

the both sides of the document are read at one time.

19. The image processing method recited in claim 13, further comprising:

sending the created file to an external sender.

20. The image processing method recited in claim 19, wherein:

inputting the image data and the text data corresponds to receiving a file including the image data and the text data appropriate for the image data, which is sent by the external sender; and the created file is returned to the external sender having sent the received file.

21. The image processing method recited in claim 19, wherein:

an application program enabling an apparatus that is the external sender to display the image data included in the created file, is sent together with the file.

22. The image processing method recited in claim 13, further comprising:

recording in a memory, a file having the image data and the voice data connected to each other, and wherein:

the image data is outputted to a display apparatus and the voice data connected to the image data is outputted to a speech output apparatus, if the file recorded in the memory is opened.

23. An image processing method comprising:

reading out image data by scanning a document having one or more than one sheets;

converting into voice data, text data extracted from the image data read out from the document having one or more than one sheets;

connecting the obtained voice data and the readout image data to each other;

outputting the image data connected to the voice data, to a display apparatus, and outputting the voice data to a speech output apparatus;

conveying the document to a reading position; and calculating the timing of completion of speech outputted by the speech output apparatus based on the voice data connected to the image data read out from one sheet of the document having a plurality of sheets, and then starting conveying a following sheet of the document.

24. The image processing method recited in claim 23, further comprising:

variably setting the speed of the voice generated by the speech output apparatus; and wherein:

the document feed speed is changed based on the set speed of the voice.

* * * * *